US008342831B2

(12) United States Patent
Barinov et al.

(10) Patent No.: US 8,342,831 B2
(45) Date of Patent: Jan. 1, 2013

(54) CONTROLLED ELECTROSPINNING OF FIBERS

(76) Inventors: Victor Barinov, Brooklyn, NY (US); Kalle Levon, Brooklyn, NY (US)

( * ) Notice: Subject to any disclaimer, the term of this patent is extended or adjusted under 35 U.S.C. 154(b) by 848 days.

(21) Appl. No.: 12/296,420

(22) PCT Filed: Apr. 9, 2007

(86) PCT No.: PCT/IB2007/003249

§ 371 (c)(1),
(2), (4) Date: Oct. 7, 2008

(87) PCT Pub. No.: WO2008/020326

PCT Pub. Date: Feb. 21, 2008

(65) Prior Publication Data

US 2009/0162468 A1 Jun. 25, 2009

(51) Int. Cl.
*D01D 5/08* (2006.01)

(52) U.S. Cl. ..... 425/66; 425/72.2; 425/135; 425/174.6; 425/174.8 R; 425/378.2; 425/382.2; 425/464

(58) Field of Classification Search ..... 425/83.1, 425/378.2, 464, 174.6, 174.8 R, 135, 66, 425/72.2, 382.2; 264/10, 405, 437, 465, 264/467, 201, 205, 209.5
See application file for complete search history.

(56) References Cited

U.S. PATENT DOCUMENTS 2,109,333 A * 2/1938 Formhals ..... 425/174
2,123,992 A * 7/1938 Formhals ..... 425/174
3,169,899 A 2/1965 Steuber
3,319,309 A 5/1967 Owens
3,689,608 A 9/1972 Hollbert et al.
3,851,023 A 11/1974 Berthauer et al.
3,860,369 A 1/1975 Berthauer et al.
4,044,404 A 8/1977 Martin et al.
4,233,014 A 11/1980 Kinney
4,689,186 A 8/1987 Bornat
4,965,110 A 10/1990 Berry
5,024,789 A 6/1991 Berry
5,296,172 A 3/1994 Davis et al.
5,744,090 A 4/1998 Jones et al.
5,817,272 A 10/1998 Frey et al.
5,911,930 A 6/1999 Kinlen et al.
6,106,913 A 8/2000 Scardino et al.
6,110,590 A 8/2000 Zarkoob et al.
6,265,333 B1 7/2001 Dzenis et al.
6,265,466 B1 7/2001 Glatkowski et al.
6,444,151 B1 9/2002 Nguyen et al.

(Continued)

OTHER PUBLICATIONS

Reneker, D. H., Yarin, A. L., Fong, H., and Koombhongse, S., "Bending instability of electrically charged liquid jets of polymer solutions in electrospinning," Journal of Applied Physics, 2000, vol. 87, No. 9, pp. 4531-4547.

(Continued)

*Primary Examiner* — Joseph Del Sole
*Assistant Examiner* — Timothy Kennedy

(57) ABSTRACT

An electrospinning apparatus for spinning polymer fibers from a fluid delivered by a jet supply device, which apparatus comprises at least one collector of a plurality of collectors in electrical communication with an electrode of the jet supply device. Collectors are insulated from each other. At least one collector comprises a stretcher adapted to stretch polymer fibers. The stretcher is an integral part of at least one collector. A controller controls sequence and time duration at which collectors are in electrical communication with the electrode of the jet supply device creating a non-woven polymer fabric or weaving polymer fibers into a fabric. The electrospinning apparatus comprises a rotator adapted to rotate the stretcher.

47 Claims, 19 Drawing Sheets

U.S. PATENT DOCUMENTS

| | | | |
|---|---|---|---|
| 6,520,425 | B1 | 2/2003 | Reneker |
| 6,616,435 | B2 | 9/2003 | Lee et al. |
| 6,641,773 | B2 | 11/2003 | Kleinmeyer et al. |
| 6,656,394 | B2 | 12/2003 | Kelly |
| 6,695,992 | B2 | 2/2004 | Reneker |
| 6,709,623 | B2 | 3/2004 | Haynes et al. |
| 6,713,011 | B2 | 3/2004 | Chu et al. |
| 6,753,454 | B1 | 6/2004 | Smith et al. |
| 6,790,528 | B2 | 9/2004 | Wendroff et al. |
| 6,858,168 | B1 | 2/2005 | Vollrath et al. |
| 6,954,240 | B2 | 10/2005 | Hamamoto et al. |
| 6,955,775 | B2 | 10/2005 | Chung et al. |
| 6,989,125 | B2 | 1/2006 | Boney et al. |
| 6,991,702 | B2 | 1/2006 | Kim |
| 6,998,165 | B2 | 2/2006 | Howland |
| 7,008,685 | B2 | 3/2006 | Groitzsch et al. |
| 7,070,640 | B2 | 7/2006 | Chung et al. |
| 7,070,723 | B2 | 7/2006 | Ruitenberg et al. |
| 7,081,622 | B2 | 7/2006 | Kameoka et al. |
| 7,105,058 | B1 | 9/2006 | Sinyagin |
| 7,105,124 | B2 | 9/2006 | Choi |
| 7,105,812 | B2 | 9/2006 | Zhao et al. |

OTHER PUBLICATIONS

Warner, S. B., Buer, A., Grimler, M., Ugbolue, S.C., Rutledge, G. C. and Shin, M. Y., "A Fundamental Investigation of the Formation and Properties of Electrospun Fibers", National Textile Center Annual Report, 1999.

Doshi, J. and Reneker, D.H., "Electrospinning Process and Applications of Electrospun Fibers", Industry Applications Society Annual Meeting, 1993, Conference Record of the 1993 IEEE, vol. 3, pp. 1698-1703, Oct. 2-8, 1993 and Journal of Electrostatics, 1995, vol. 35, pp. 151-160.

Reneker, D.H. and Chun, I., "Nanometre Diameter Fibres of Polymer, Produced by Electrospinning", Nanotechnology, 1996, vol. 7, pp. 216-223.

Elmarco, "Nanospider for Nonwovens", Technische Textilien 2005, 48.3 (E174) (Ref: World Textile Abstracts 2006).

* cited by examiner

CONTROLLED ELECTROSPINNING OF FIBERS

BACKGROUND OF THE INVENTION

1. Field of the Invention

The present invention relates generally to electrospinning of fibers and more particularly to controlled electrospinning of fibers.

2. Background Art

Electrospinning has been known, since the 1930's. However, electrospinning of fibers has not previously gained significant industrial importance, owing to a variety of issues, some of these having been low output, inconsistent and low molecular orientation, poor mechanical properties, difficulties and instabilities of fluid streams in forming fibers, and high diameter distribution of the electrospun fibers. Although special needs of military, medical and filtration applications have stimulated recent studies and renewed interest in the electrospinning, quantitative technical and scientific information regarding process and product characterization are extremely limited.

In a typical electrospinning system, a charged polymer solution (or melt) is fed through a small opening or orifice of a nozzle (usually a needle or pipette tip), and because of its charge, the polymer solution is drawn (as a jet) toward a collector, which is often a grounded collecting plate (usually a metal screen, plate, or rotating mandrel), typically 5-30 cm from the orifice of the nozzle. During the jet's travel, the solvent gradually evaporates, and a charged polymer fiber is left to accumulate on the grounded target. The charge on the fibers eventually dissipates into the surrounding environment. The resulting product is a non-woven fiber mat that is composed of tiny fibers with diameters between 50 nanometers and 10 microns. This non-woven mat forms the foundation of a "scaffold". If the target is allowed to move with respect to the nozzle position, specific fiber orientations (parallel alignment or a random) can be achieved. Previous work has shown that varying the fiber diameter and orientation can vary the mechanical properties of the scaffold.

Using electrical forces alone, electrospinning can produce fibers with nanometer diameters. Electrospun fibers have large surface to volume ratios, because of their small diameters, which enable them to absorb more liquids than do fibers having large diameters, and small pore sizes make them suitable candidates for military and civilian filtration applications. It is expected that electrospun fibers will find many applications in composite materials and as reinforcements.

Typically, an electric field is used to draw a positively charged polymer solution from an orifice of a nozzle to a collector, and "electrospin" the polymer solution, as the polymer solution travels from the orifice to the collector. A jet of solution typically flows or travels from the orifice of the nozzle to the collector, which is typically grounded. The jet emerges from the nozzle, which is typically of a conical geometry, and often, in particular, a Taylor cone. The jet transitions to form a stretched jet, after the jet leaves the orifice of the nozzle, and then the jet divides into many fibers in an area called the "splaying region".

As the jet of positively charged polymer solution travels from the orifice to the collector, a "whipping motion" (or bending instability) results in the jet.

There is thus a need for apparatus and methods that control the jet and minimize instabilities of the jet as it travels from the nozzle to the collector plate. The apparatus and methods should be capable of controlling the jet, the path of the jet, controlling and minimizing instabilities of these fluid streams during formation of fibers, and controlling the direction of the jet and concentration of solution during electrospinning.

The apparatus and methods should be capable of producing substantially long fibers for use as nano filaments and nano filament lines, and to aid in weaving fabrics of nanofibers. The apparatus and methods should also be capable of stretching the nanofibers during construction, production, processing, and manufacturing of the nanofibers, as a means of modifying the properties of the nanofibers, and enhancing physical parameters, chemical parameters, strength, resilience, size, diameter, orientation, molecular structure, electrical properties, and other key properties.

Control of electrospinning-process variables determines the production rate and the electrospun fiber structure and properties in terms of size, diameter distribution, orientation, supermolecular structure; and mechanical, electrical, and optical properties. The apparatus and methods should also be capable controlling of electrospinning-process variables determines the production rate and the electrospun fiber structure and properties in terms of size, diameter distribution, orientation, supermolecular structure; and mechanical, electrical, and optical properties.

The formation of fibers by electrospinning is also impacted by the viscosity of spinnable fluids, since some spinnable fluids are so viscous that they require higher forces than electric fields can typically produce without arcing, i.e., dielectric breakdown of the air. Likewise, these techniques have been problematic where high temperatures are required, since high temperatures typically increase the conductivity of structural parts and complicate the control of high strength electrical fields. The apparatus and methods should, thus, also be capable of controlling the jet and minimizing instabilities for fluids of different viscosities, and should be capable of controlling the jet during the use of extreme temperatures and high strength electrical fields.

The apparatus and methods that control and minimize instabilities of the jet should be capable of improving efficiency, productivity, and economy of the electrospinning process. The apparatus and methods should also be capable of more accurate use of fluids, improvements in production and formation of fibers, and improvements in the production rate, fiber diameter distribution, measure, and characterization of the electrospun fiber properties in terms of size, orientation and mechanical properties.

Different electrospinning apparatus and methods have heretofore been known. However, none of the electrospinning apparatus and methods adequately satisfies these aforementioned needs.

U.S. Pat. No. 6,713,011 (Chu, et al.) discloses an apparatus and method for electrospinning polymer fibers and membranes. The method includes electrospinning a polymer fiber from a conducting fluid in the presence of a first electric field established between a conducting fluid introduction device and a ground source and modifying the first electric field with a second electric field to form a jet stream of the conducting fluid. The method also includes electrically controlling the flow characteristics of the jet stream, forming a plurality of electrospinning jet streams and independently controlling the flow characteristics of at least one of the jet streams. The apparatus for electrospinning includes a conducting fluid introduction device containing a plurality of electrospinning spinnerets, a ground member positioned adjacent to the spinnerets, a support member disposed between the spinnerets and the ground member and movable to receive fibers formed from the conducting fluid, and a component for controlling the flow characteristics of conducting fluid from at least one spinneret independently from another spinneret.

U.S. Pat. No. 4,689,186 (Bornat) discloses production of electrostatically spun products, comprising electrostatically spinning a fiberizable liquid, the electrostatic field being distorted by the presence of an auxiliary electrode, preferably so as to encourage the deposition of circumferential fibers, having tubular portions.

U.S. Pat. No. 6,520,425 (Reneker) discloses a process and apparatus for the production of nanofibers, in which a nozzle is used for forming nanofibers by using a pressurized gas stream comprises a center tube, a first supply tube that is positioned concentrically around and apart from the center tube, a middle gas tube positioned concentrically around and apart from the first supply tube, and a second supply tube positioned concentrically around and apart from the middle gas tube. The center tube and first supply tube form a first annular column. The middle gas tube and the first supply tube form a second annular column. The middle gas tube and second supply tube form a third annular column. The tubes are positioned, so that first and second gas jet spaces are created between the lower ends of the center tube and first supply tube, and the middle gas tube and second supply tube, respectively. A method for forming nanofibers from a single nozzle is also disclosed.

U.S. Pat. No. 6,641,773 (Kleinmeyer, et al.) discloses electro spinning of submicron diameter polymer filaments, in which an electro spinning process yields substantially uniform, nanometer diameter polymer filaments. A thread-forming polymer is extruded through an anodically biased die orifice and drawn through an anodically biased electrostatic field. A continuous polymer filament is collected on a grounded collector. The polymer filament is linearly oriented and uniform in quality. The filament is particularly useful for weaving body armor, for chemical/biological protective clothing, as a biomedical tissue growth support, for fabricating micro sieves and for microelectronics fabrication.

U.S. Pat. No. 6,991,702 (Kim) discloses an electrospinning apparatus, including a spinning dope main tank, a metering pump, a nozzle block, a collector positioned at the lower end of the nozzle block for collecting spun fibers, a voltage generator, a plurality of units for transmitting a voltage generated by the voltage generator to the nozzle block and the collector, the electrospinning apparatus containing a spinning dope drop device positioned between the metering pump and the nozzle block, the spinning dope drop device having (i) a sealed cylindrical shape, (ii) a spinning dope inducing tube and a gas inletting tube for receiving gas through its lower end and having its gas inletting part connected to a filter aligned side-by-side at the upper portion of the spinning dope drop device, (iii) a spinning dope discharge tube extending from the lower portion of the spinning dope drop device and (iv) a hollow unit for dropping the spinning dope from the spinning dope inducing tube formed at the middle portion of the spinning dope drop device.

U.S. Pat. No. 6,989,125 (Boney, et al.) discloses a process of making a nonwoven web, resulting in continuous fiber nonwoven webs with high material formation uniformity and MD-to-CD balance of fiber directionality and material properties, as measured by a MD:CD tensile ratio of 1.2 or less, and laminates of the nonwoven webs. The invention also includes a method for forming the nonwoven webs, wherein a fiber production apparatus is oriented at an angle less than 90 degrees to the MD direction, and the fibers are subjected to deflection by a deflector oriented at an angle B, with respect to the centerline of the fiber production apparatus, where B is about 10 to about 80 degrees.

U.S. Pat. No. 4,233,014 (Kinney) discloses a process and apparatus for forming a non-woven web in which a bundle of untwisted filaments are charged upstream of a pair of elastomer covered counter rotating squeeze rolls and propelled through the nip of the rolls to a moving laydown belt, with the assistance of an electrostatic field developed between the rolls and the belt.

U.S. Pat. No. 6,616,435 (Lee, et al.) discloses an electrospinning method and apparatus for manufacturing a porous polymer web, which includes the steps of: forming, pressurizing and supplying at least one or more kinds of polymer materials in a liquid state; and discharging and piling the polymer materials to a collector through one or more charged nozzles, the collector being located under the nozzles and charged to have a polarity opposing the polarity of the charged nozzles, the collector moving at a prescribed speed.

U.S. Pat. No. 5,744,090 (Jones, et al.) discloses a process for the manufacture of conductive fibers, usable in electrostatic cleaning devices, in which the conductive fiber is formed from a mixture, including at least one fiber forming material and conductive magnetic materials, and the conductive magnetic materials are migrated toward the periphery of the fiber by application of a magnetic field to the fiber. The conductive fibers having the conductive magnetic materials located at the periphery of the fiber are preferably incorporated into an electrostatic cleaning device for use in an electrostatographic printing device.

U.S. Pat. No. 5,817,272 (Frey, et al.) discloses a process of making a biocompatible porous hollow fiber that is made of polyolefin material and is coated with a biocompatible carbon material is disclosed. The biocompatible hollow fiber produced can be used as exchange material, diaphragms and/or semipermeable membranes within devices, which will contact blood or plasma outside of the living body. The coated fiber is produced by introducing a preformed porous hollow fiber into an atmosphere of gaseous monomer vinylidene chloride and subsequent induction, e.g. by gamma radiation, of a graft-polymerization reaction to form a uniform polyvinylidene chloride layer. The ultimate coating is formed after a dehydrochlorination reaction in which hydrogen chloride is removed from the layer. The dechlorination reaction is typically performed by treating the fiber with hot concentrated aqueous ammonia solution. The reaction can be continued to reduce the chlorine content of the coating to less than 6% of its original value.

U.S. Pat. No. 6,858,168 (Vollrath, et al.) discloses an apparatus and method for forming a liquid spinning solution into a solid formed product, whereby the solution is passed through at least one tubular passage, having walls formed at least partly of semipermeable and/or porous material. The semipermeable and/or porous material allows certain parameters, such as the concentration of hydrogen ions, water, salts and low molecular weight, of the liquid spinning solution to be altered as the spinning solution passes through the tubular passage(s).

U.S. Pat. No. 6,444,151 (Nguyen, et al.) discloses an apparatus and process for spinning polymeric filaments, in which a melt spinning apparatus for spinning continuous polymeric filaments, includes a first stage gas inlet chamber adapted to be located below a spinneret and optionally a second stage gas inlet chamber located below the first stage gas inlet chamber. The gas inlet chambers supply gas to the filaments to control the temperature of the filaments. The melt spinning apparatus also includes a tube located below the second stage gas inlet chamber, for surrounding the filaments as they cool. The tube may include an interior wall having a converging section, optionally followed by a diverging section.

U.S. Pat. No. 6,110,590 (Zarkoob, et al.) discloses synthetically spun silk nanofibers and a process for making the same, in which a silk nanofiber composite network is produced by forming a solution of silk fiber and hexafluroisopropanol, wherein the step of forming is devoid of any acid treatment, where the silk solution has a concentration of about 0.2 to about 1.5 weight percent silk in hexafluroisopropanol, and where the silk is selected from *Bombyx mori* silk and *Nephila clavipes* silk; and electrospinning the solution, thereby forming a non-woven network of nanofibers having a diameter in the range from about 2 to about 2000 nanometers.

U.S. Pat. No. 6,265,466 (Glatkowski, et al.) discloses an electromagnetic shielding composite having nanotubes and a method of making the same. According to one embodiment, the composite for providing electromagnetic shielding includes a polymeric material and an effective amount of oriented nanotubes for EM shielding, the nanotubes being oriented when a shearing force is applied to the composite. According to another embodiment of the invention, the method for making an electromagnetic shielding includes the steps of (1) providing a polymer with an amount of nanotubes, and (2) imparting a shearing force to the polymer and nanotubes to orient the nanotubes.

U.S. Pat. No. 6,656,394 (Kelly) discloses a method and apparatus for high throughput generation of fibers by charge injection, in which a fiber is formed by providing a stream of a solidifiable fluid, injecting the stream with a net charge, so as to disrupt the stream and allowing the stream to solidify to form fibers.

U.S. Pat. Nos. 6,955,775 and 7,070,640 (Chung, et al.) disclose a process of making fine fiber material, including improved polymer materials and fine fiber materials, which can be made from the improved polymeric materials, in the form of microfiber and nanofiber structures. The microfiber and nanofiber structures can be used in a variety of useful applications including the formation of filter materials.

U.S. Pat. No. 6,753,454 (Smith, et al.) discloses electrospun fibers and an apparatus therefor. A fiber comprising a substantially homogeneous mixture of a hydrophilic polymer and a polymer, which is at least weakly hydrophobic is disclosed. The fiber optionally contains a pH adjusting compound. A method of making the fiber comprises electrospinning fibers of the substantially homogeneous polymer solution. A method of treating a wound or other area of a patient requiring protection from contamination comprises electrospinning the substantially homogeneous polymer solution to form a dressing. An apparatus for electrospinning a wound dressing is disclosed.

U.S. Pat. No. 5,911,930 (Kinlen, et al.) discloses solvent spinning of fibers containing an intrinsically conductive polymer, including a fiber containing an organic acid salt of an intrinsically conductive polymer distributed throughout a matrix polymer along, with a method for providing such fibers by spinning a solution, which includes an organic acid salt of an intrinsically conductive polymer, a matrix polymer, and a spinning solvent into a coagulation bath including a nonsolvent for both the organic acid salt of an intrinsically conductive polymer and the matrix polymer. The intrinsically conductive polymer-containing fibers typically have electrical conductivities below about 10.sup.-5 S/cm.

U.S. Pat. No. 6,695,992 (Reneker) discloses a process and apparatus for the production of nanofibers, including an apparatus for forming a non-woven mat of nanofibers, by using a pressurized gas stream, which includes parallel, spaced apart, first, second, and third members, each having a supply end and an opposing exit end. The second member is located apart from and adjacent to the first member. The exit end of the second member extends beyond the exit end of the first member. The first and second members define a first supply slit. The third member is located apart from and adjacent to the first member on the opposite side of the first member from the second member. The first and third members define a first gas slit, and the exit ends of the first, second and third members define a gas jet space. A method for forming a non-woven mat of nanofibers utilizes this nozzle.

U.S. Pat. No. 7,070,723 (Ruitenberg, et al.) discloses a method for spin-drawing of melt-spun yarns. A method is provided for simultaneous spin-drawing of continuous yarns consisting of one or more filaments, comprising the steps in which a melt of a thermoplastic material is fed to a spinning device, the melt is extruded through a spinneret, by means of extrusion openings with the formation of continuous yarns, the continuous yarns are cooled by feeding them through a first and a second cooling zone, wherein the continuous yarns are cooled essentially by a stream of air on passing through the first cooling zone and essentially by a fluid, consisting wholly or partly of a component that is liquid at room temperature, on passing through the second cooling zone, and the continuous yarns are then dried, subsequently drawn and wound up by means of winding devices, the method being distinguished in that the continuous yarns are fed through the first and second cooling zones at a speed of up to 500 m/min and that the residence time of the continuous yarns within the first cooling zone is at least 0.1 sec.

U.S. Pat. No. 7,105,058 (Sinyagin) discloses an apparatus and method for forming a microfiber coating, which includes directing a liquid solution toward a deposition surface. The apparatus includes a tube defining a volume through which the liquid solution travels. An electric field is applied between the origin of the liquid solution and the surface. A gas is injected into the tube to create a vortex flow within the tube. This vortex flow protects the deposition surface from entrainment of ambient air from the surrounding atmosphere.

U.S. Pat. No. 7,105,812 (Zhao, et al.) discloses a microfluidic chip with enhanced tip for stable electrospray ionization, in which a microfluidic chip is formed with multiple fluid channels terminating at a tapered electrospray ionization tip for mass spectrometric analysis. The fluid channels may be formed onto a channel plate that is in fluid communication with corresponding reservoirs. The electrospray tip can be formed along a defined distal portion of the channel plate that can include a single or multiple tapered surfaces. The fluid channels may terminate at an open-tip region of the electrospray tip. A covering plate may substantially enclose most portions of the fluid channels formed on the channel plate except for the open-tip region. Another aspect of the invention provides methods for conducting mass spectrometric analyses of multiple samples flowing through individual fluid channels in a single microfluidic chip that is formed with a tapered electrospray tip having an open-tip region.

U.S. Pat. No. 5,296,172 (Davis, et al.) discloses an electrostatic field enhancing process and apparatus for improved web pinning and uniformity in a fibrous web forming operation. The improvements are achieved by imposing an auxiliary electrostatic field above the fibrous web as it is pinned along a moving collection surface. An auxiliary electrostatic field enhancing plate is positioned above the web and collection surface and downstream of the laydown position where the web initially is deposited on the collection surface. The plate enhances the electrostatic field in the region above the collection surface and thereby increases the web pinning forces. When the invention is applied to a flash-spinning process, where trifluorochloromethane is used as the fluid medium, an auxiliary electrostatic field of between about 2 and 80 kV/cm, preferably between about 10 and 60 kV/cm, is applied by the plate.

U.S. Pat. No. 3,860,369 (Berthauer, et al.) and U.S. Pat. No. 3,851,023 (Berthauer, et al.) disclose apparatus for making non-woven fibrous sheet and a process for forming a web; U.S. Pat. No. 3,319,309 (Owens) discloses charged web collecting apparatus; and U.S. Pat. No. 3,689,608 (Hollbert, et al.) discloses a process for forming a nonwoven web.

U.S. Pat. No. 4,965,110 (Berry) and U.S. Pat. No. 5,024,789 (Berry) disclose a method and apparatus for manufacturing an electrostatically spun structure; U.S. Pat. No. 4,044,404 (Martin, et al.) discloses a fibrillar lining for a prosthetic device prepared by electrostatically spinning an organic material and collecting the spun fibers on a receiver; and U.S. Pat. No. 3,169,899 (Steuber) discloses non woven fibrous sheet of continuous strand material and the method of making same.

U.S. Pat. No. 7,105,124 (Choi) discloses a method, apparatus, and product for manufacturing nanofiber media; U.S. Pat. No. 7,081,622 (Kameoka, et al.) discloses an electrospray emitter for a microfluidic channel; U.S. Pat. No. 6,106,913 (Scardino, et al.) discloses fibrous structures containing nanofibrils and other textile fibers; U.S. Pat. No. 6,709,623 (Haynes, et al.) discloses a process of and apparatus for making a nonwoven web; and U.S. Pat. No. 6,790,528 (Wendroff, et al.) discloses production of polymer fibers having nanoscale morphologies.

U.S. Pat. No. 6,954,240 (Hamamoto, et al.) discloses a method of producing a polarizing plate, and liquid crystal display comprising the polarizing plate. The polarizing plate includes a polarizing film and a protective layer bonded to a surface of the polarizing film, where the protective layer has substantially no irregularities, such as record grooves, caused by stretching of the polarizing film, so that the polarizing plate with an improved appearance provides clear images even when reflected light is applied. The polarizing plate is produced by laminating a protective layer on at least one surface of a polarizer, while limiting moisture content of the polarizer to a range from 5% to 30%. A value for the moisture content is obtained by a calculation based on an equation of moisture content (%)=[(A−B)/B]·times·100, when A denotes weight of the polarizer before bonding and B denotes weight of the polarizer after being kept in a dryer of 120.degree. C. for seven hours.

U.S. Pat. No. 6,998,165 (Howland) discloses a laminate system for a durable controlled modulus flexible membrane, in which a fabric system for producing at least a woven fabric of controlled modulus or elongation in the MD or warp axis, has a core layer which is the main structural element, and may have one or more woven cover fabrics adhesively bonded with an off axis configuration to one or both sides of the core layer. In a preferred embodiment, the core fabric is covered with at least one off axis fabric on both sides. The cover fabrics may also have resin or film top layers laminated or coated on their outside surfaces, for mechanical performance or UV protection or both.

U.S. Pat. No. 7,008,685 (Groitzsch, et al.) discloses a laminated material and method for its production, in which a laminate has a first cover layer, a fabric with perforations as the middle layer, and a second cover layer, as are a method for its production and the use of the laminate as a fluid absorption and distribution layer made of a nonwoven fabric layer oriented in the Z direction, for absorbent hygiene articles. A three-dimensional form is achieved in that the fabric is present in the shrunk state in the middle layer, i.e. is brought into this state.

U.S. Pat. No. 6,265,333 (Dzenis, et al.) discloses delamination resistant composites prepared by small diameter fiber reinforcement at ply interfaces. A fiber reinforced composite material comprising a resin matrix and primary reinforcement fibers and further comprising secondary, smaller diameter, reinforcement fibers at one or more ply interfaces, or portion thereof, provides improved interlaminar toughness, strength, and delamination resistance without substantial reduction of in-plane properties and without substantial increase in weight. In one embodiment, the small fibers are attached to one side of a conventional prepreg prior to lamination. The small fibers are flexible and are expected to conform to the shape and distribution of the primary reinforcing fibers at the interface.

Reneker, D. H., Yarin, A. L., Fong, H., and Koombhongse, S., "Bending instability of electrically charged liquid jets of polymer solutions in electrospinning," Journal of Applied Physics, 2000, 87, No 9, pp. 4531-4547 discloses bending instability of electrically charged liquid jets of polymer solutions in electrospinning. Nanofibers of polymers were electrospun by creating an electrically charged jet of polymer solution at a pendent droplet. After the jet flowed away from the droplet in a nearly straight line, the jet bent into a complex path and other changes in shape occurred, during which electrical forces stretched and thinned it by very large ratios. After the solvent evaporated, birefringent nanofibers were left. The reasons for the instability are analyzed and explained, using a mathematical model. The theological complexity of the polymer solution is included, which allows consideration of viscoelastic jets. It is shown that the longitudinal stress caused by the external electric field acting on the charge carried by the jet stabilized the straight jet for some distance. Then a lateral perturbation grew in response to the repulsive forces between adjacent elements of charge carried by the jet. The motion of segments of the jet grew rapidly into an electrically driven bending instability. The three-dimensional paths of continuous jets were calculated, both in the nearly straight region, where the instability grew slowly and in the region where the bending dominated the path of the jet. The mathematical model provides a reasonable representation of the experimental data, particularly of the jet paths determined from high speed videographic observations.

Warner, S. B., Buer, A., Grimler, M., Ugbolue, S. C., Rutledge, G. C. and Shin, M. Y., "A Fundamental Investigation of the Formation and Properties of Electrospun Fibers", National Textile Center Annual Report, 1999 discusses the fundamental engineering science and technology of electrostatic fiber production ("electrospinning"). Electrospinning and its capabilities for producing novel synthetic fibers of unusually small diameter and good mechanical performance ("nanofibers"), and fabrics with controllable pore structure and high surface area are discussed. The following items are included: design and construction of process equipment for controllable and reproducible electrospinning; clarification of the fundamental electrohydrodynamics of the electrospinning process and, correlation to the polymer fluid characteristics; characterization and evaluation of the fluid instabilities postulated to be crucial for producing ultrafine diameter fibers; characterization of the morphology and material properties of electrospun polymer fibers; development of techniques for generating oriented fibers and yarns by the electrospinning process; and productivity improvement of the electrospinning process.

Doshi, J. and Reneker, D. H., "Electrospinning Process and Applications of Electrospun Fibers", Industry Applications Society Annual Meeting, 1993, Conference Record of the 1993 IEEE, Volume 3, Pages 1698-1703, Oct. 2-8, 1993 and Journal of Electrostatics, 1995, Volume 35, pages 151-160 disclose the use of an electric field to create a charged jet of polymer solution. As the jet travels in air, solvent evaporates, leaving behind a charged fiber that can be electrically deflected or collected on a metal screen. Fibers with a variety of cross-sectional shapes and sizes were produced from different polymers, having diameters in the range of 0.05 to 5 microns. An electrospinning process, processing conditions, fiber morphology, and some possible uses of electrospun fibers are disclosed.

Reneker, D. H. and Chun, I., "Nanometer Diameter Fibres of Polymer, Produced by Electrospinning", Nanotechnology, Volume 7, pages 216-223, 1996 discloses electrospinning using electrical forces to produce polymer fibers with nanometer-scale diameters. Accordingly, electrospinning occurs when the electrical forces at the surface of a polymer solution or melt overcome the surface tension and cause an electrically charged jet to be ejected. When the jet dries or solidifies, an electrically charged fiber remains. The charged fiber can be directed or accelerated by electrical forces and then collected in sheets or other useful geometrical forms. More than 20 polymers, including polyethylene oxide, nylon, polyimide, DNA, polyaramid, and polyaniline, were electrospun. Most were spun from solution, although spinning from the melt in vacuum and air was also demonstrated. Electrospinning from polymer melts in a vacuum was described as being advantageous, because higher fields and higher temperatures can be used than in air.

Elmarco, "Nanospider for Nonwovens", Technische Textilien 2005, 48.3 (E174) (Ref: World Textile Abstracts 2006), discloses the development of nanospider spinning technology, in which nanofibers are produced using a strong electric field. A spinning head in the shape of a roller is used, in which a rotating head is immersed half way in a polymer solution with a requisite amount carried to the peak of the roller, where Taylor cones are formed. Nanofibers with diameters of 50-500 nm are produced. Non wovens are produced for filters, acoustic insulation, hygiene products, cosmetics, and composites.

For the foregoing reasons, there is a need for apparatus and methods that control the jet and minimize instabilities of the jet as it travels from the nozzle to the collector plate. The apparatus and methods should be capable of controlling the jet, the path of the jet, and the concentration of solution during electrospinning.

The apparatus and methods should also be capable of controlling the jet and minimizing instabilities for fluids of different viscosities, and should be capable of controlling the jet, during the use of extreme temperatures and high strength electrical fields.

The apparatus and methods should be capable of producing substantially long fibers for use as nano filaments and nano filament lines, and to aid in weaving fabrics of nanofibers. The apparatus and methods should also be capable of stretching the nanofibers during construction, production, processing, and manufacturing of the nanofibers, as a means of modifying the properties of the nanofibers, and enhancing physical parameters, chemical parameters, strength, resilience, size, diameter, orientation, molecular structure, electrical properties, and other key properties.

Control of electrospinning-process variables determines the production rate and the electrospun fiber structure and properties in terms of size, diameter distribution, orientation, supermolecular structure; and mechanical, electrical, and optical properties. The apparatus and methods should also be capable controlling of electrospinning-process variables determines the production rate and the electrospun fiber structure and properties in terms of size, diameter distribution, orientation, supermolecular structure; and mechanical, electrical, and optical properties.

The apparatus and methods that control and minimize instabilities of the jet should be capable of improving efficiency, productivity, and economy of the electrospinning process. The apparatus and methods should also be capable of more accurate use of fluids, improvements in production and formation of fibers, and improvements in the production rate, fiber diameter distribution, measure, and characterization of the electrospun fiber properties in terms of size, orientation and mechanical properties.

SUMMARY

The present invention is directed to electrospinning apparatus and methods that control a jet or jets of solution during the electrospinning process. The present invention minimizes instabilities of the jet(s) as it travels from the nozzle to the collector plate. The apparatus and methods are capable of controlling the jet(s), the path of the jet(s), and the concentration of solution during electrospinning.

The apparatus and methods of the present invention are capable of producing substantially long fibers for use as nano filaments and nano filament lines, and to aid in weaving fabrics of nanofibers. The present invention is capable of stretching the nanofibers during construction, production, processing, and manufacturing of the nanofibers, as a means of modifying the properties of the nanofibers, and enhancing physical parameters, chemical parameters, strength, resilience, size, diameter, orientation, molecular structure, electrical properties, and other key properties.

Control of electrospinning-process variables determines the production rate and the electrospun fiber structure and properties in terms of size, diameter distribution, orientation, supermolecular structure; and mechanical, electrical, and optical properties. The apparatus and methods of the present invention are also capable controlling of electrospinning-process variables determines the production rate and the electrospun fiber structure and properties in terms of size, diameter distribution, orientation, supermolecular structure; and mechanical, electrical, and optical properties.

The apparatus and methods are also capable of controlling the jet(s) and minimizing instabilities for fluids of different viscosities, and are capable of controlling the jet(s), during the use of extreme temperatures and high strength electrical fields.

The apparatus and methods that control and minimize instabilities of the jet(s) are also capable of improving efficiency, productivity, and economy of the electrospinning process. The present invention is capable of more accurate use of fluids, improvements in production and formation of fibers, and improvements in the production rate, fiber diameter distribution, measure, and characterization of the electrospun fiber properties in terms of size, orientation and mechanical properties.

An electrospinning apparatus for spinning a polymer fiber from a fluid that comprises a polymer, having features of the present invention comprises: a plurality of collectors; a jet supply device delivering a quantity of fluid; at least one collector of the plurality of collectors in electrical communication with the jet supply device during at least one time duration, the at least one collector and the jet supply device adapted to form an electric field therebetween and draw the quantity of fluid from the jet supply device toward the at least one collector and form the polymer fiber at the at least one collector of the plurality of collectors in electrical communication with the jet supply device during the at least one time duration; a controller controlling sequence and the at least one time duration of which of each the at least one collector of the plurality of collectors is in electrical communication with the jet supply device at least once during a time period.

An electrospinning method for spinning a polymer fiber from a fluid comprising a polymer in the presence of an electric field established between at least one collector of a plurality of collectors and a jet supply device, having features of the present invention comprises: a) forming an electrospinning jet stream of the fluid directed toward the at least one collector of the plurality of collectors; b) controlling sequence and at least one time duration of which of each the at least one collector of the plurality of collectors forms the electric field between the at least one collector of the plurality of collectors and the jet supply device at least once during a time period; c) drawing the jet stream toward each of the at least one collector of the plurality of collectors having the electric field between the at least one collector of the plurality of collectors and the jet supply device during the at least one time duration; d) forming the polymer fiber at each of the at least one collector of the plurality of collectors having the electric field between the at least one collector of the plurality of collectors and the jet supply device during the at least one time duration.

Another electrospinning apparatus for spinning a polymer fiber from a fluid that comprises a polymer, having features of the present invention comprises: at least one collector comprising a frame; a jet supply device delivering a quantity of fluid; the at least one collector in electrical communication with the jet supply device, the at least one collector and the jet supply device adapted to form an electric field therebetween and draw the quantity of fluid from the jet supply device toward the at least one collector and form the polymer fiber at the frame of the at least one collector.

Another electrospinning apparatus for spinning a polymer fiber from a fluid that comprises a polymer, having features of the present invention comprises: at least one collector comprising a collector having a stretcher; a jet supply device delivering a quantity of fluid; the at least one collector in electrical communication with the jet supply device, the at least one collector and the jet supply device adapted to form an electric field therebetween and draw the quantity of fluid from the jet supply device toward the at least one collector and form the polymer fiber at the at least one collector; the stretcher adapted to stretch the polymer fiber.

DRAWINGS

These and other features, aspects, and advantages of the present invention will become better understood with regard to the following description, appended claims, and accompanying drawings where:

Figure 4:
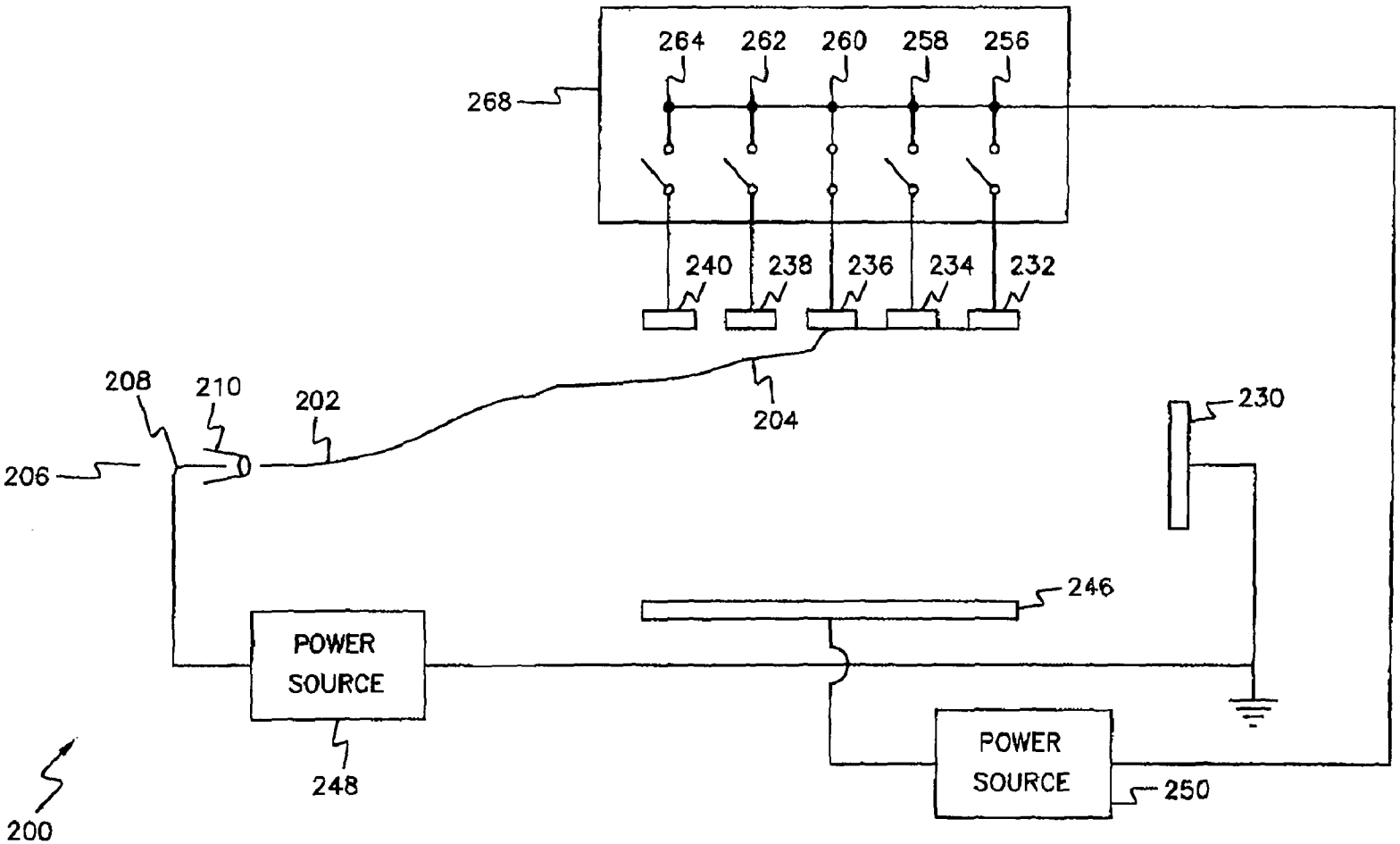
FIG. 4 is a schematic representation of an alternate embodiment of an electrospinning apparatus, having a controller and switches for controlling an electric field between at least one collector of a plurality of collectors and a jet of the electrospinning apparatus and electrodes for additional control of the electric field.
Figure 5:
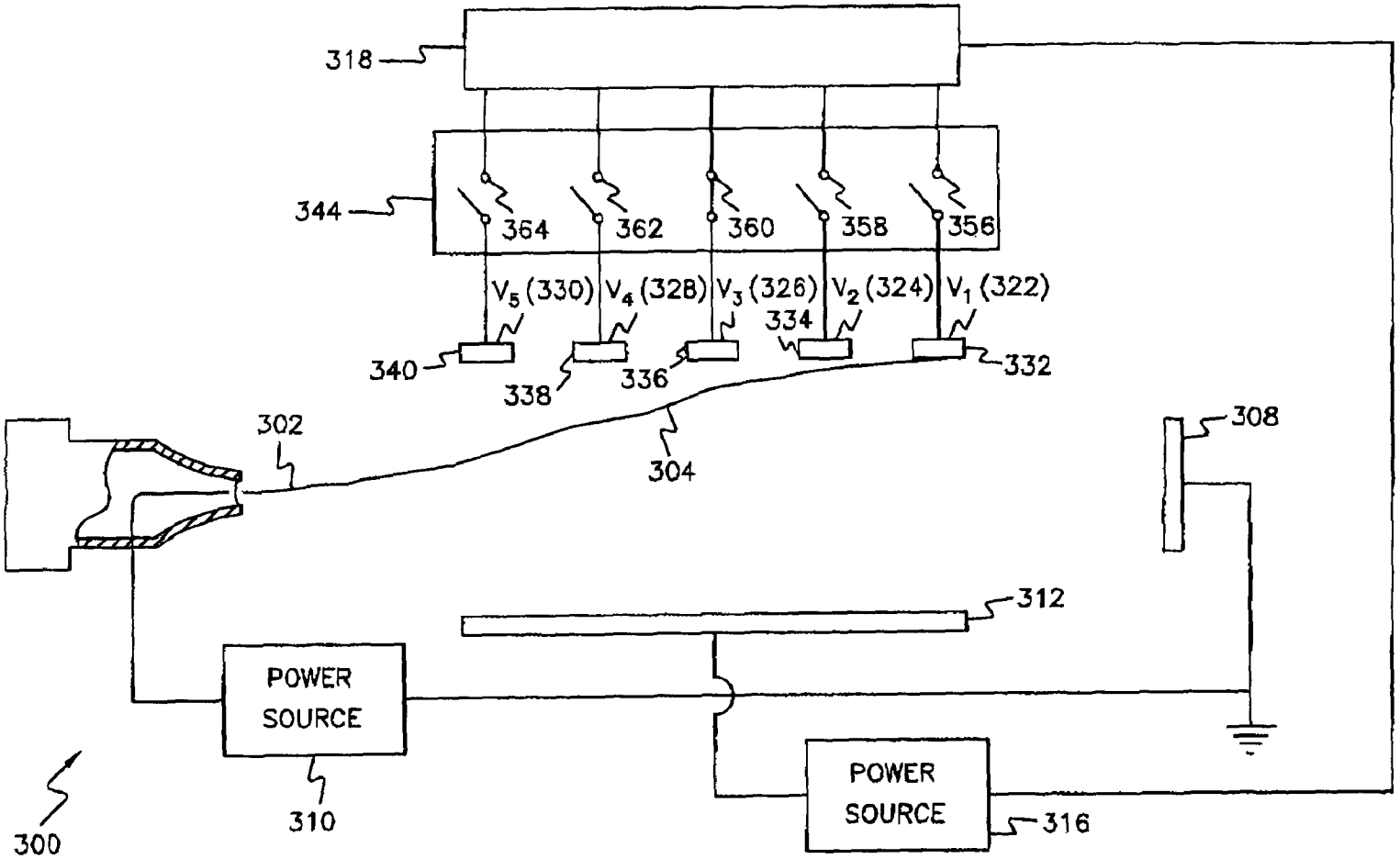
Figure 6:
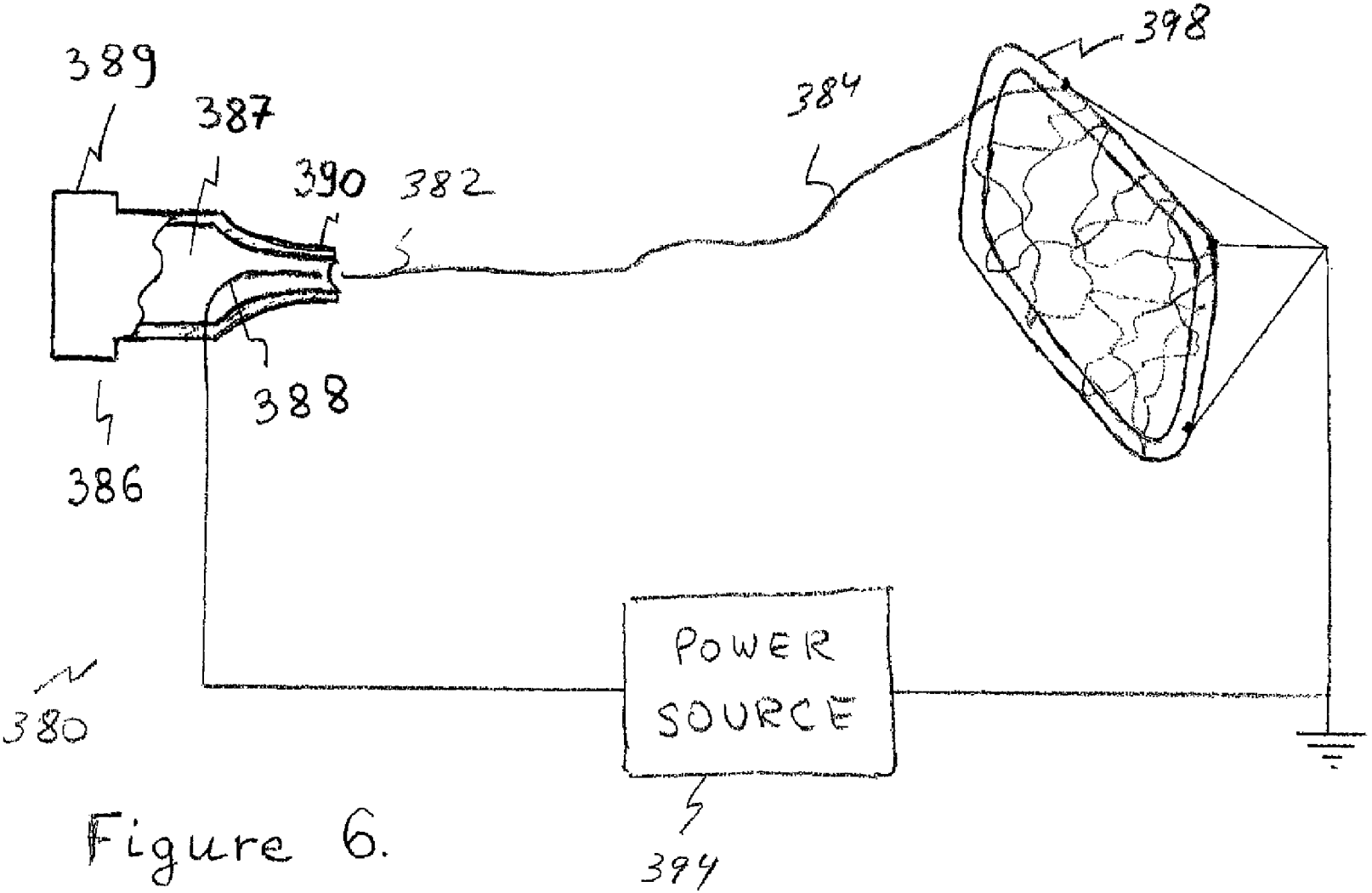
Figure 7:
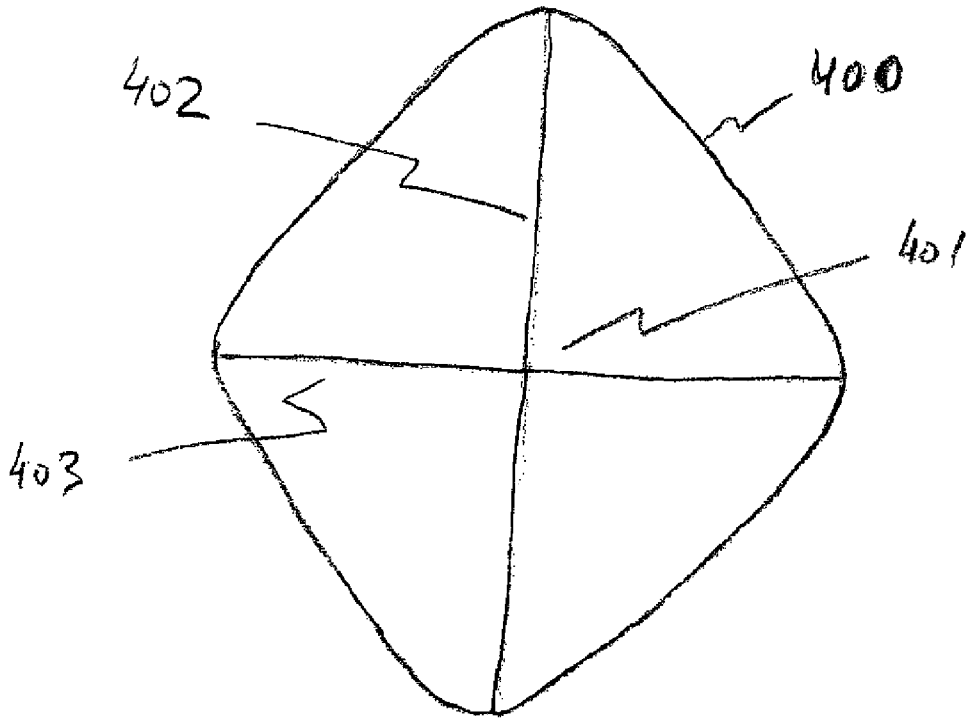
Figure 8:
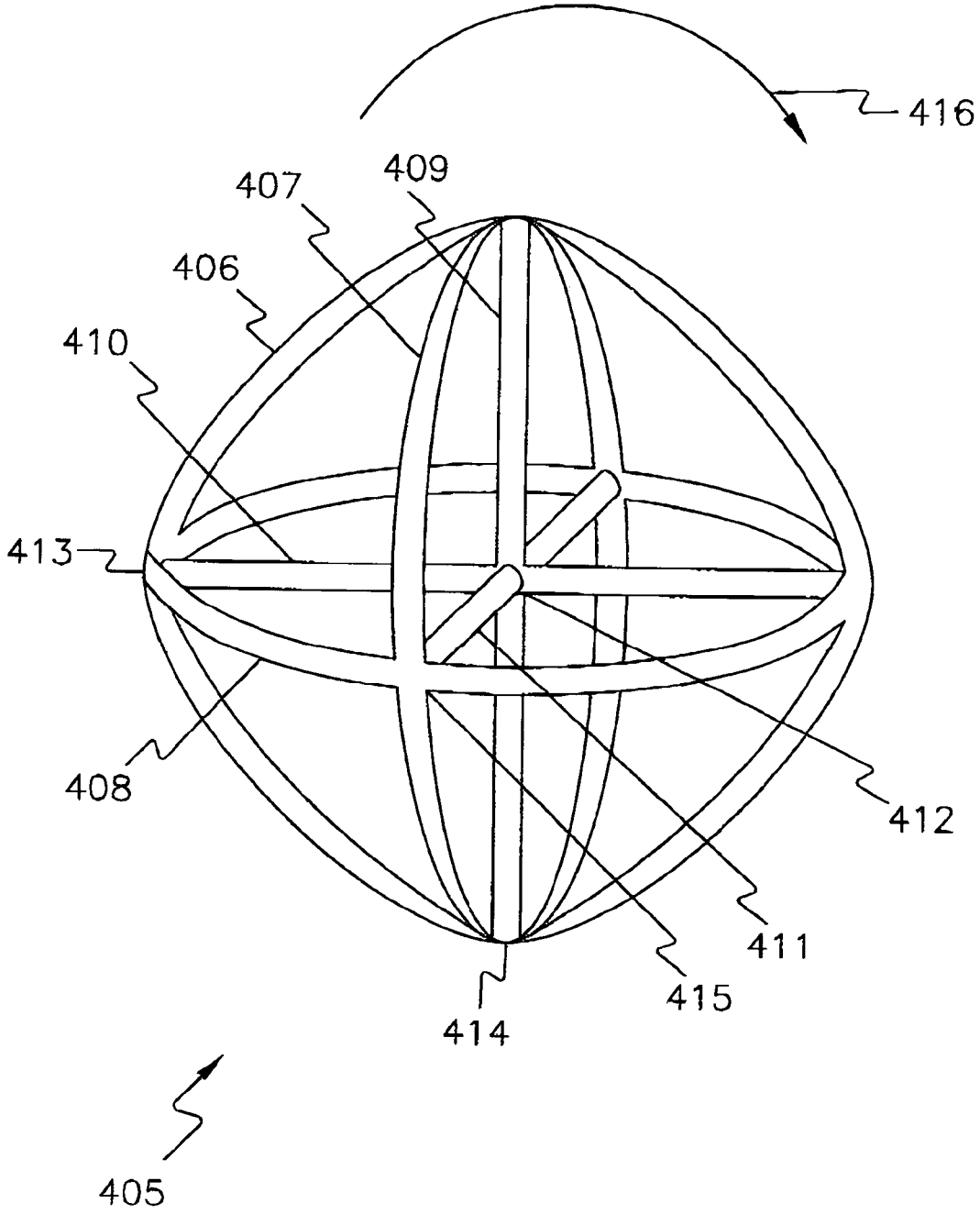
Figure 9:
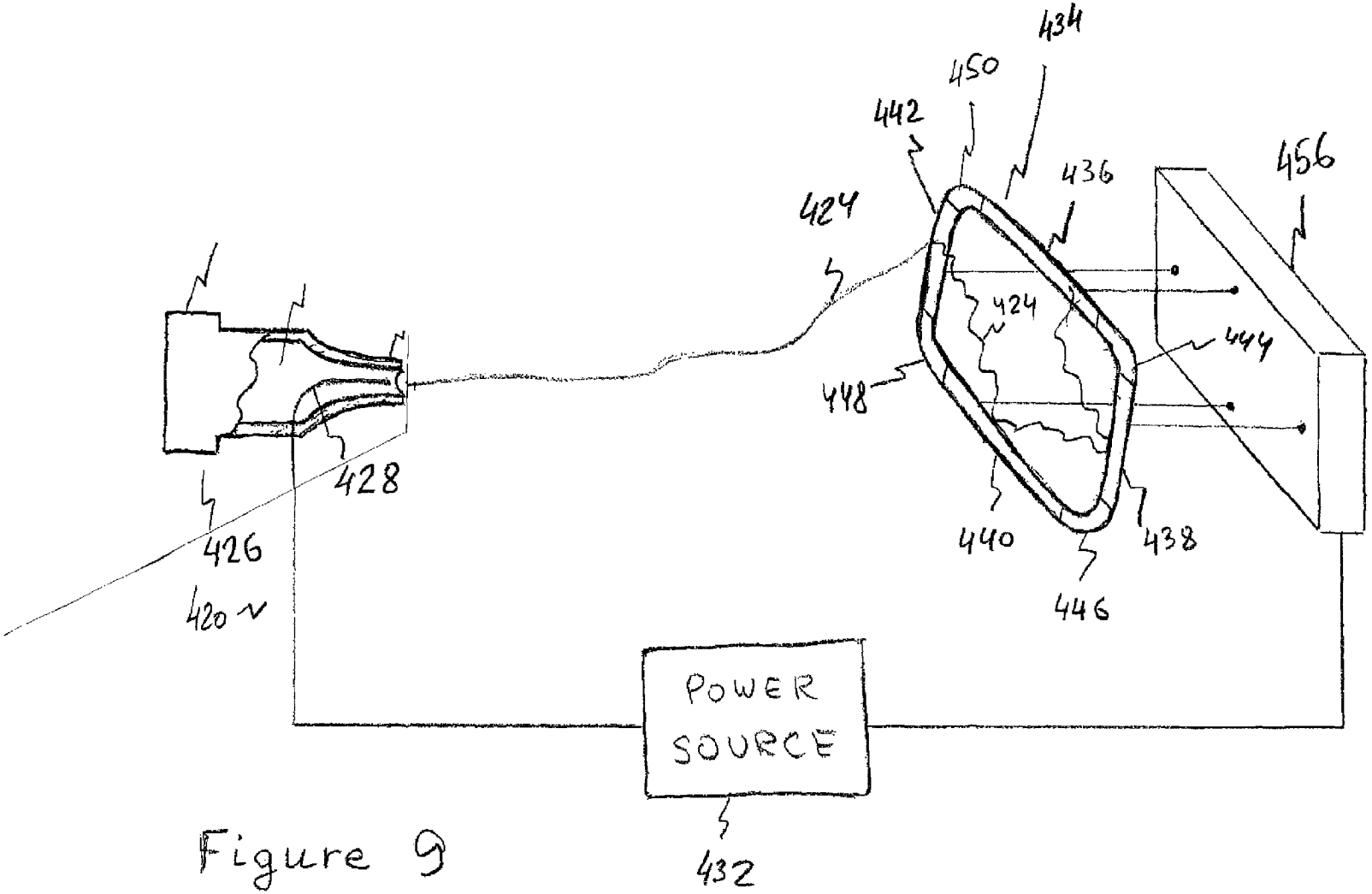
Figure 10:
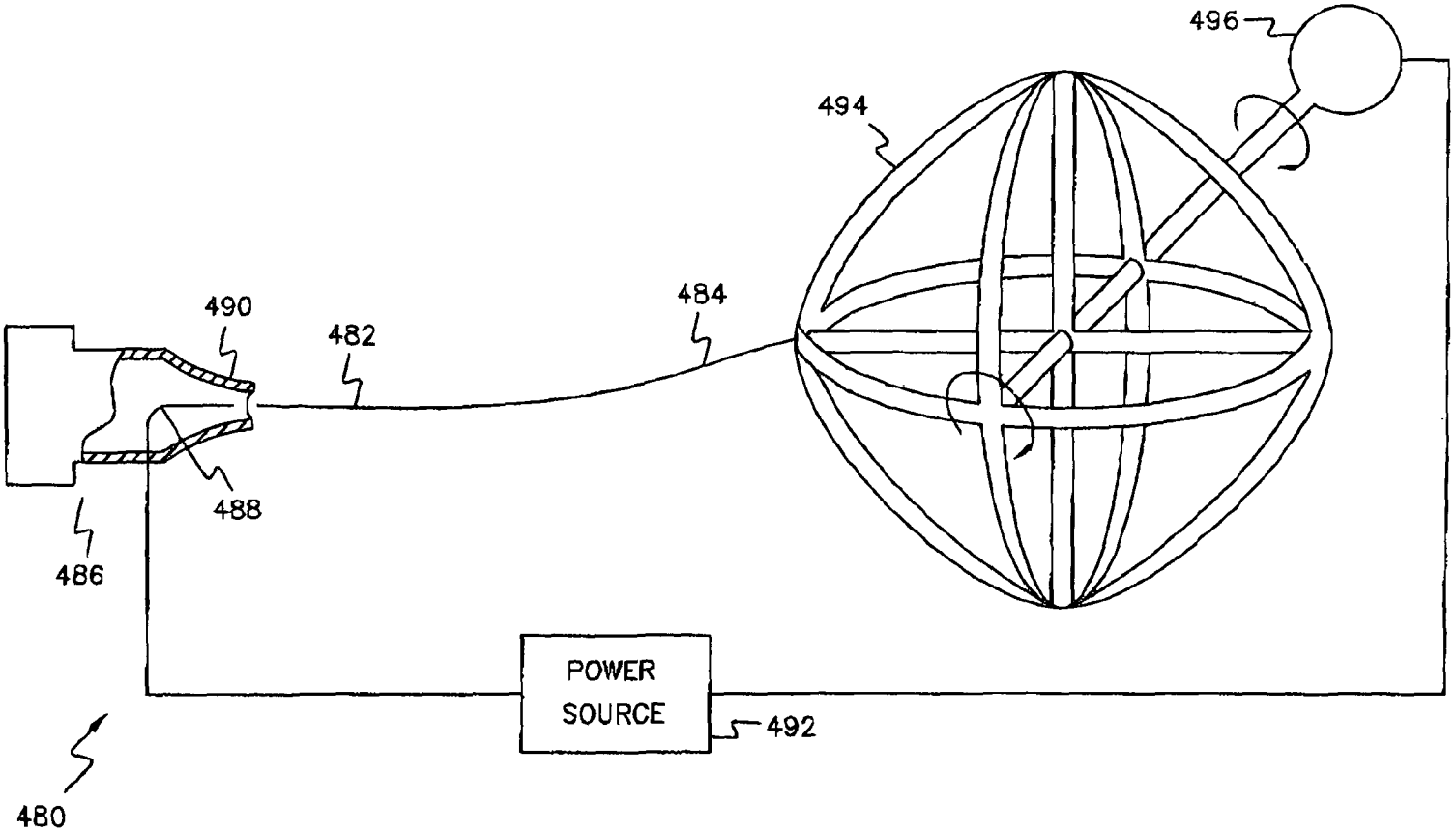
Figure 11:
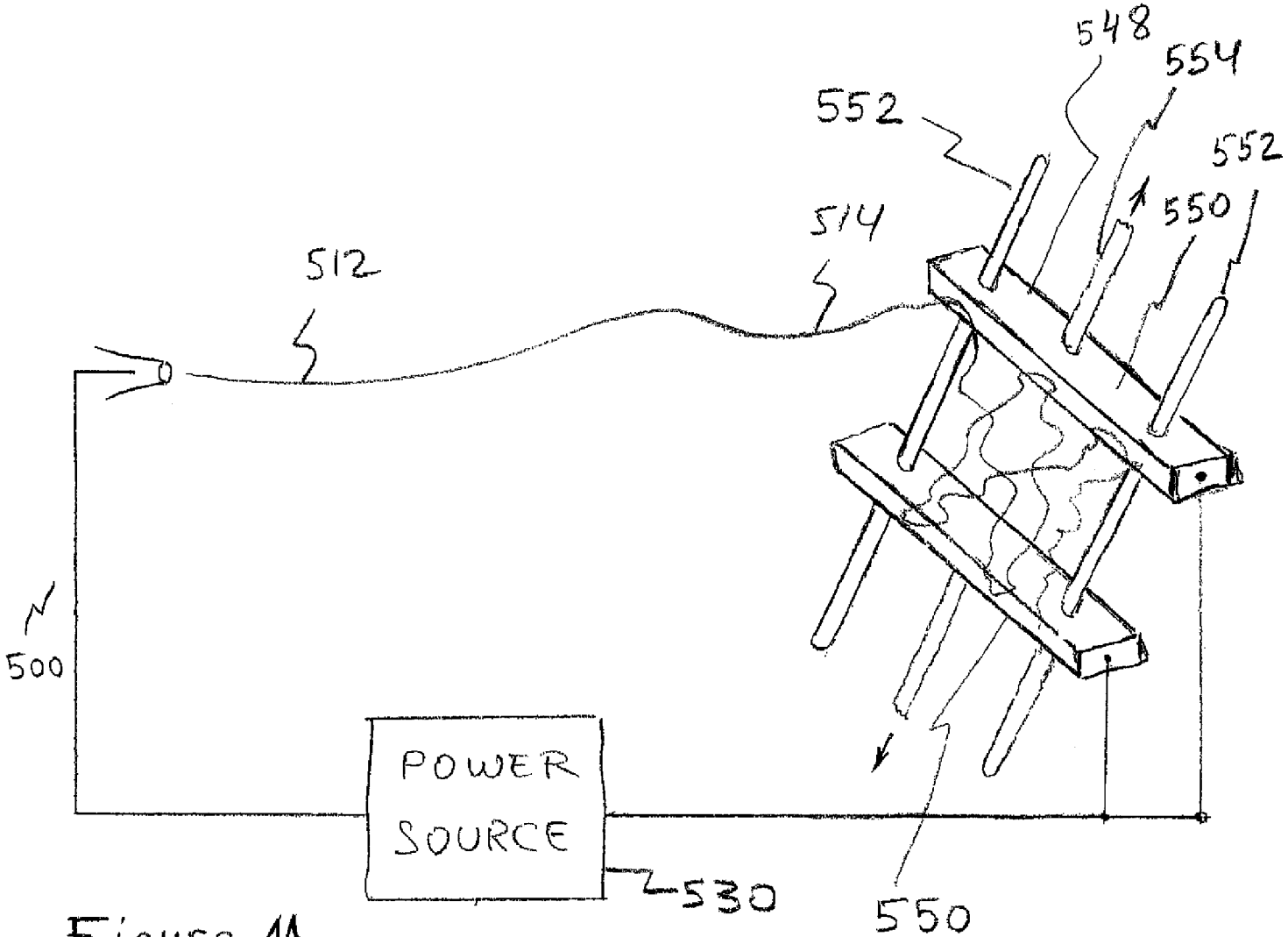
Figure 12:
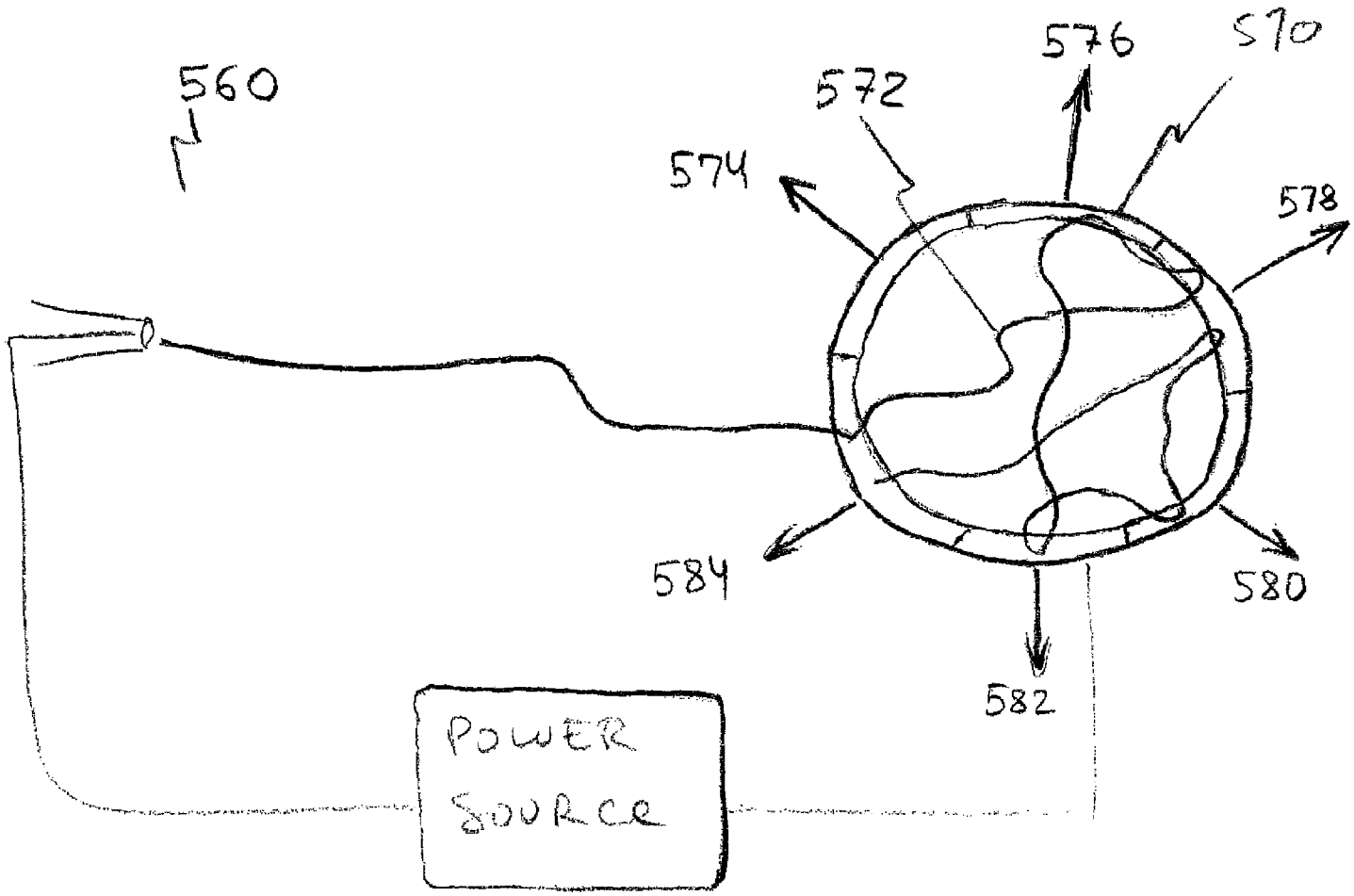
Figure 13:
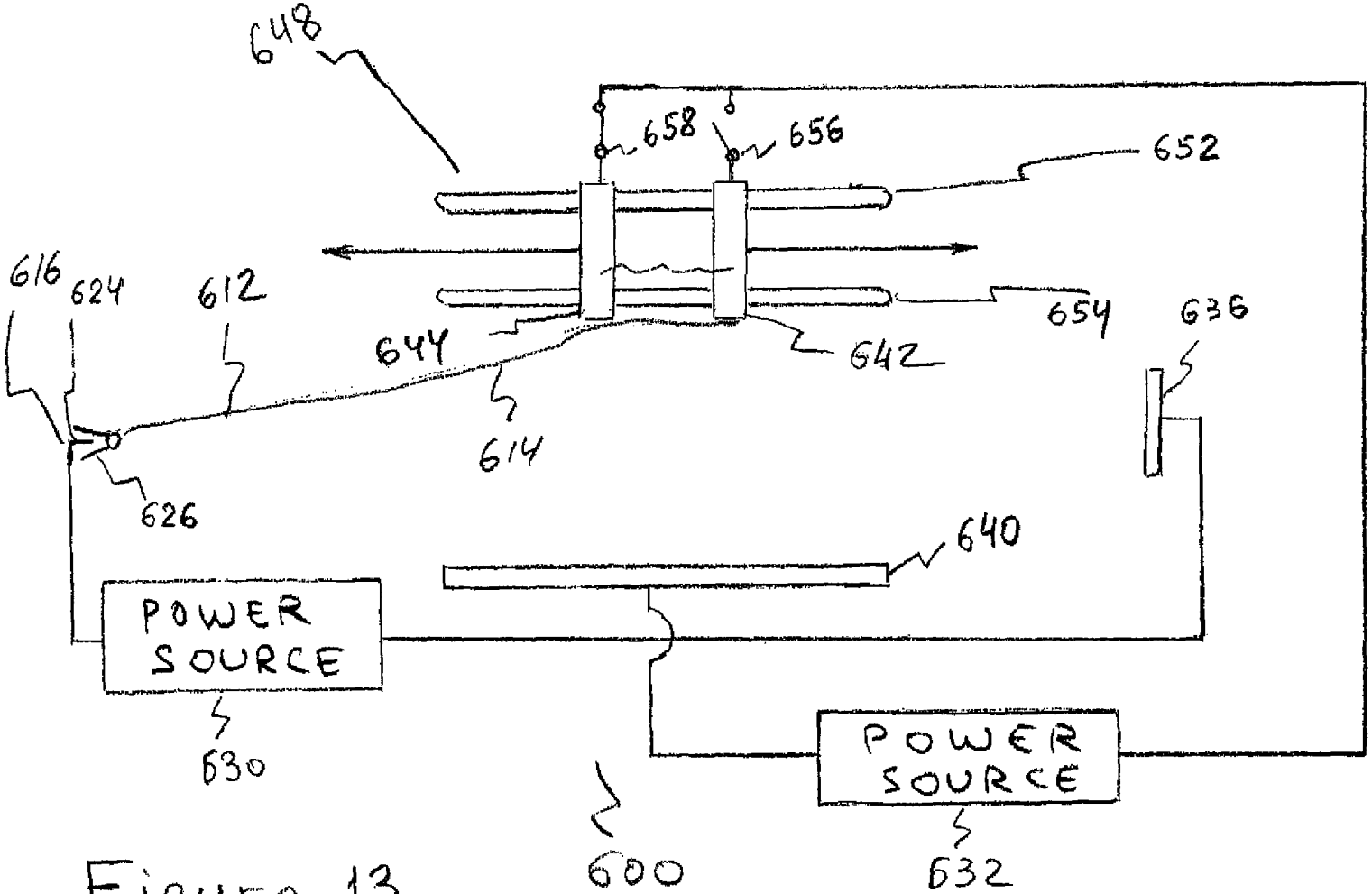
Figure 14:
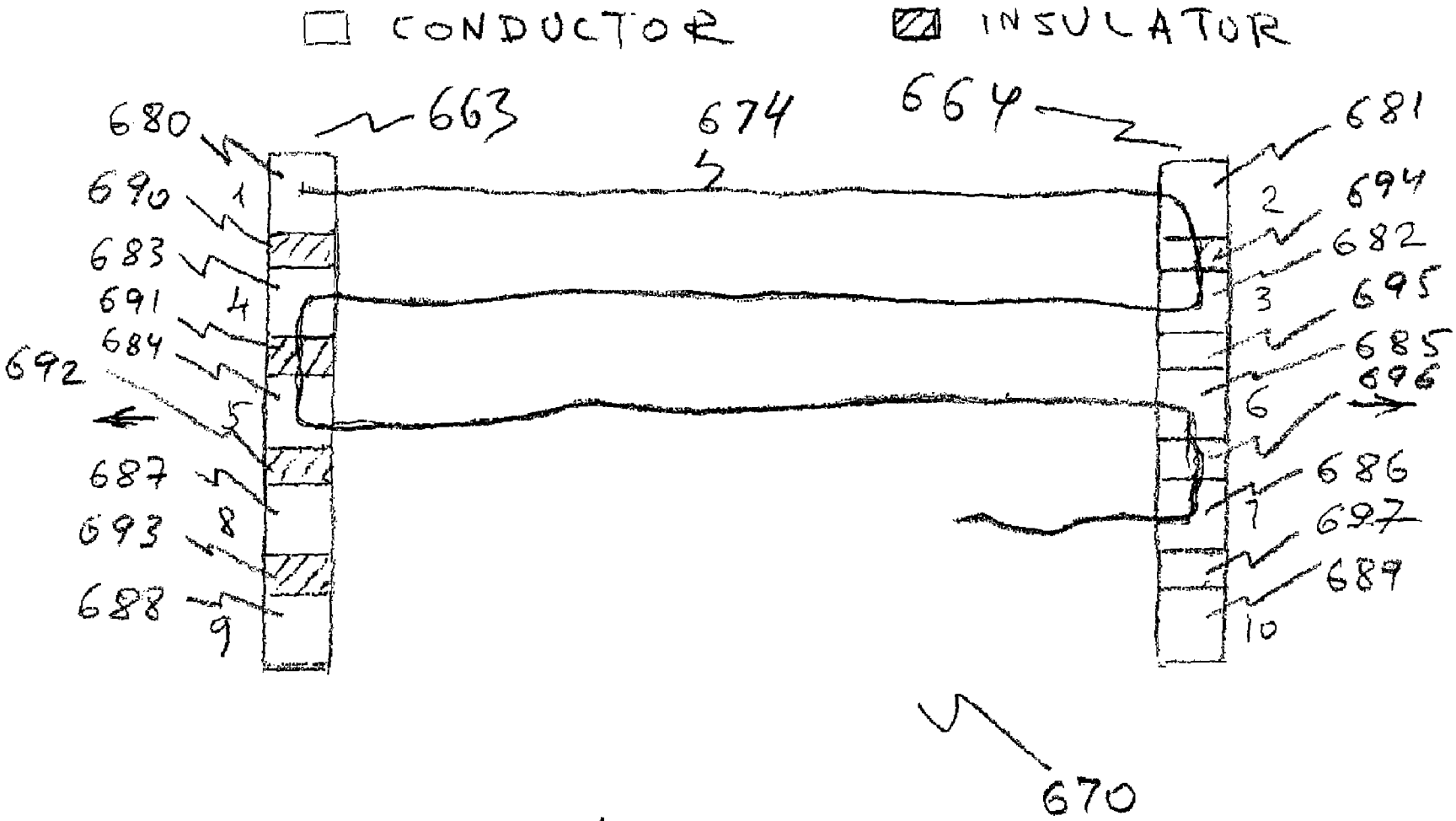
Figure 15:
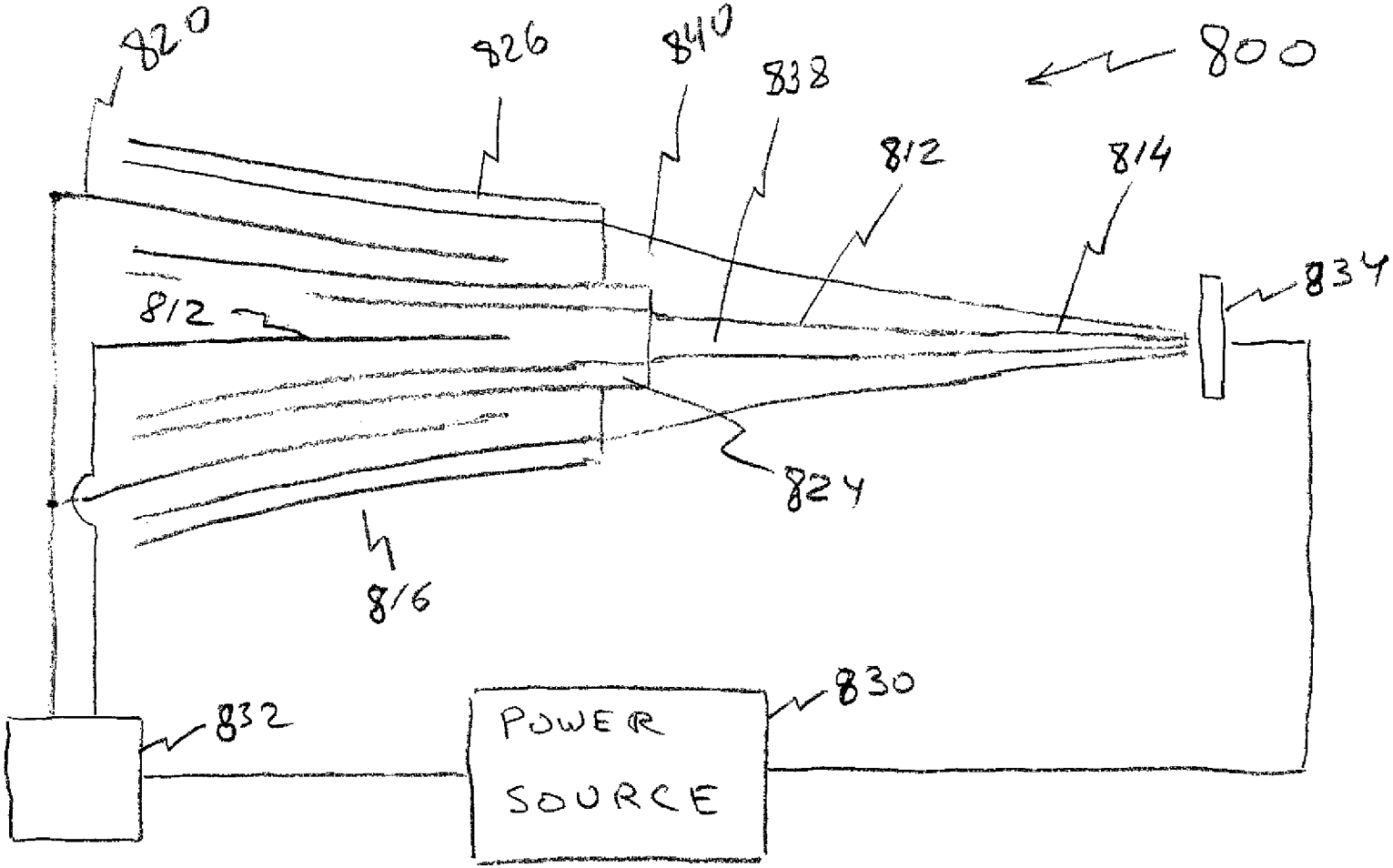
Figure 16:
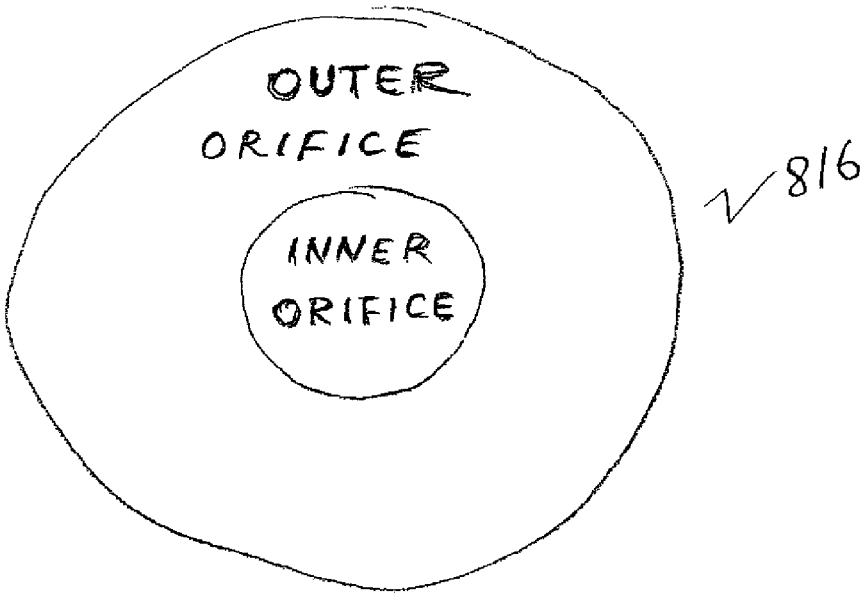
Figure 17:
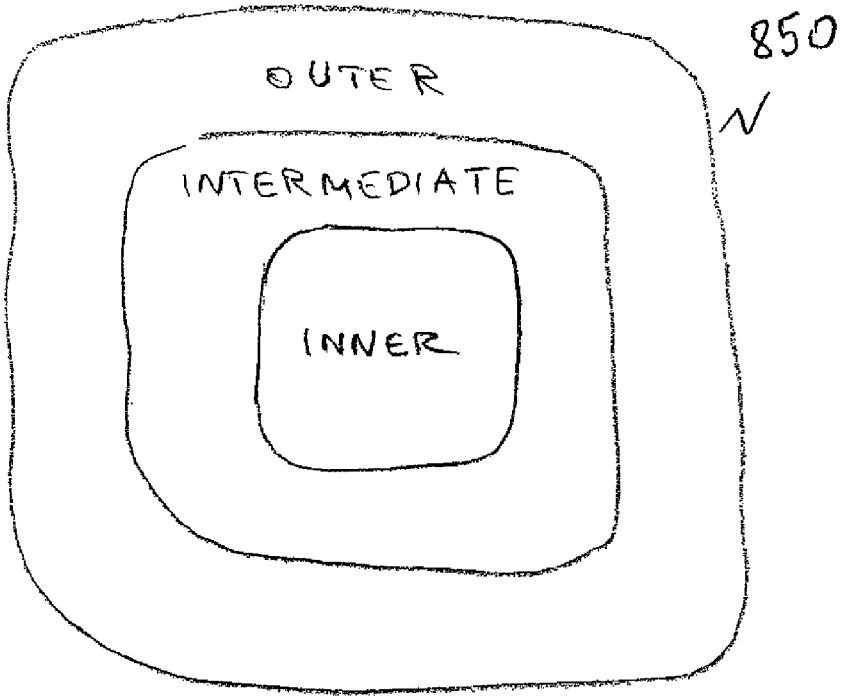
Figure 18:
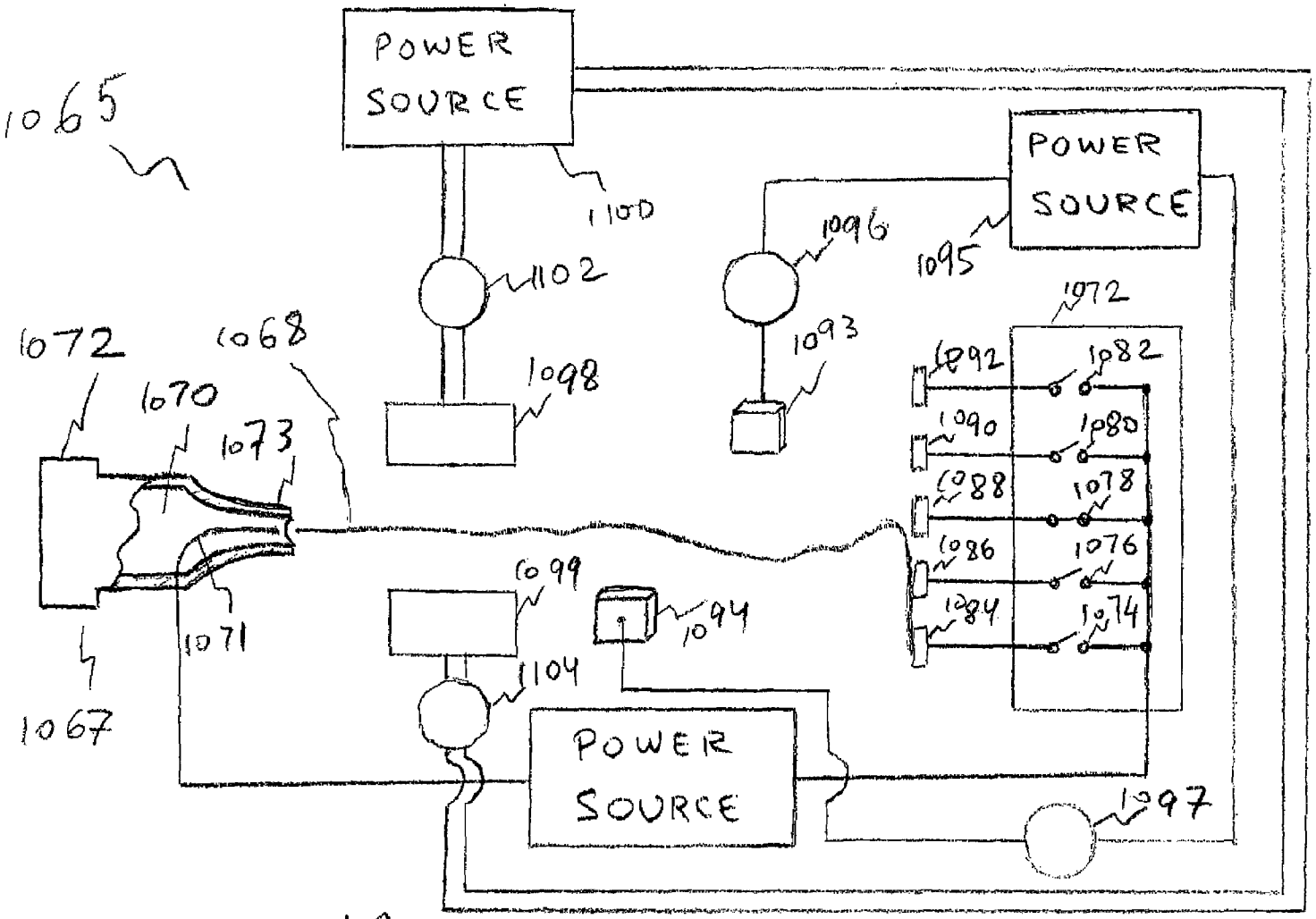
Figure 19:
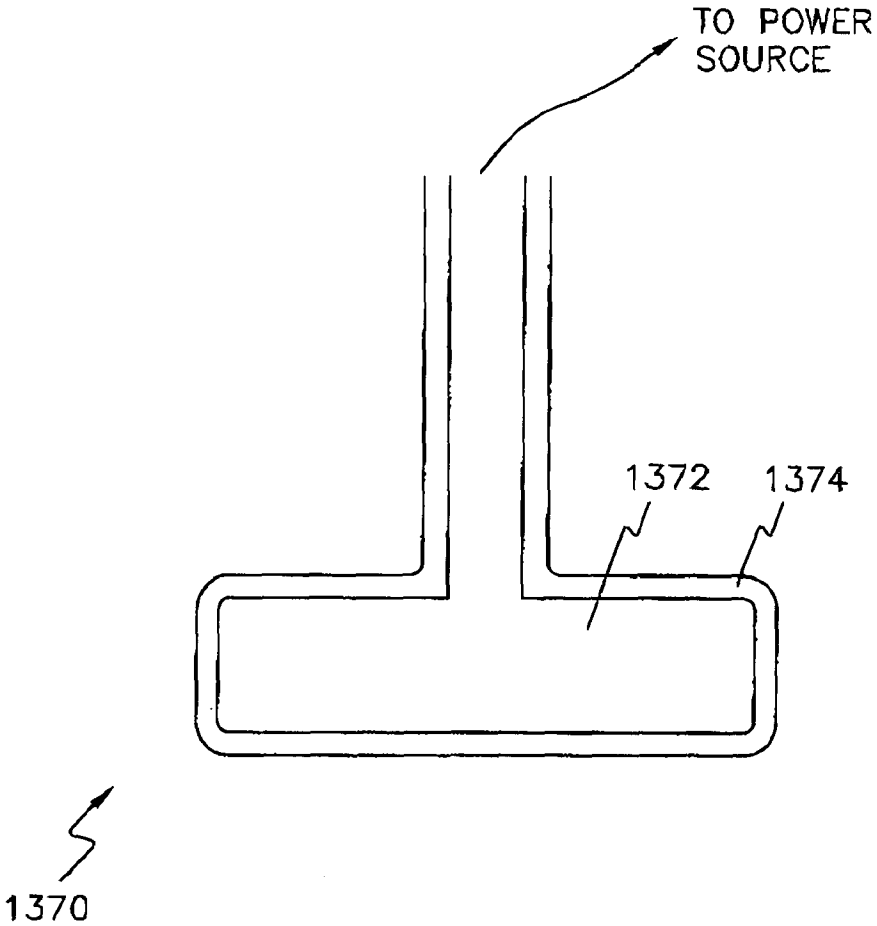
Figure 20:
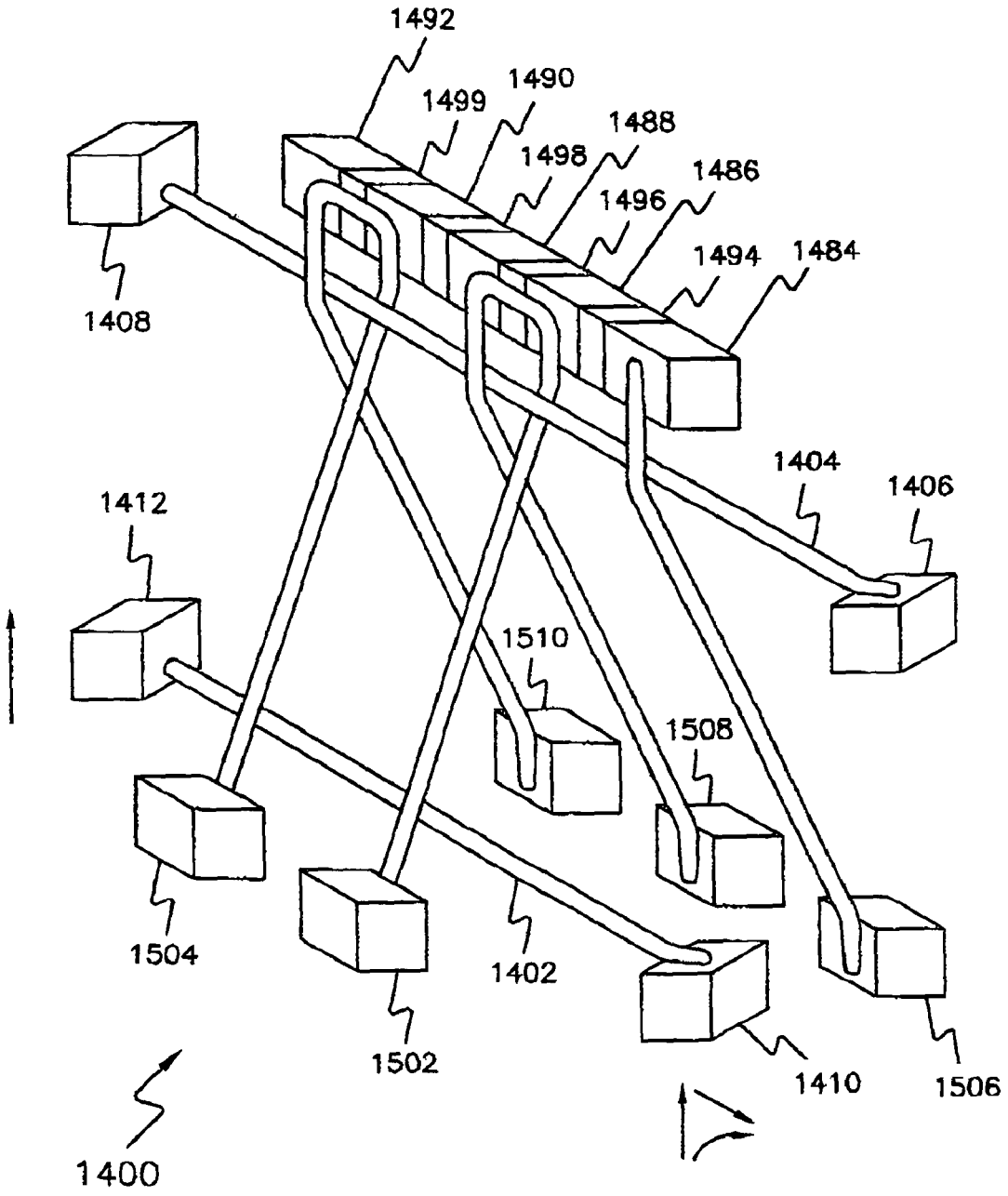

FIG. 5 is a schematic representation of an alternate embodiment of an electrospinning apparatus of FIG. 4, having a controller and switches for controlling the electric field between at least one collector of a plurality of collectors and a jet of the electrospinning apparatus, at least two of the collectors having different voltages applied thereto, and electrodes for additional control of the electric field;

FIG. 6 is a schematic representation of an alternate embodiment of an electrospinning apparatus, constructed in accordance with the present invention, having a collector frame;

FIG. 7 is a schematic representation of an alternate embodiment of a collector frame;

FIG. 8 is a schematic representation of an alternate embodiment of a collector frame;

FIG. 9 is a schematic representation of an alternate embodiment of an electrospinning apparatus, constructed in accordance with the present invention, having an alternate collector frame comprising sub collector frame portions and an electric field controller for controlling an electric field between at least one of the sub collector frame portions and the jet;

FIG. 10 is a schematic representation of an alternate embodiment of an electrospinning apparatus, constructed in accordance with the present invention, having a rotating collector frame;

FIG. 11 is a schematic representation of an alternate embodiment of an electrospinning apparatus, constructed in accordance with the present invention, having a collector stretcher;

FIG. 12 is a schematic representation of an alternate embodiment of an electrospinning apparatus, constructed in accordance with the present invention, having an alternate collector stretcher;

FIG. 13 is a schematic representation of an alternate embodiment of the electrospinning apparatus of FIG. 11, having a collector stretcher, and electrodes;

FIG. 14 is a schematic representation of opposing collector stretcher elements of an alternate embodiment of a collector stretcher;

FIG. 15 is a schematic representation of an alternate embodiment of an electrospinning apparatus, constructed in accordance with the present invention, having a jet supply device comprising a plurality of coaxially disposed outlets;

FIG. 16 is a schematic representation of an end view of the jet supply device of FIG. 15;

FIG. 17 is a schematic representation of an end view of an alternate embodiment of a jet supply device;

FIG. 18 is a schematic representation of an alternate embodiment of an electrospinning apparatus, constructed in accordance with the present invention, having electrodes and magnetic field generating devices for generating an electric field and a magnetic field, respectively, transverse to a jet of the electrospinning apparatus and controlling dispersion of the jet; and FIG. 19 is a schematic representation of a side view of an alternative embodiment of a collector; and FIG. 20 is a schematic representation of a loom for weaving electrospun fibers.

DESCRIPTION

The preferred embodiments of the present invention will be described with reference to FIGS. 1-20 of the drawings. Identical elements in the various figures are identified with the same reference numbers.

During electrospinning, typically, an electric field is used to draw a positively charged polymer solution from an orifice of a nozzle to a collector, and "electrospin" the polymer solution, as the polymer solution travels from the orifice to the collector. A jet of solution typically flows or travels from the orifice of the nozzle to the collector, which is typically grounded. The jet emerges from the nozzle, which is typically of a conical geometry, and often, in particular, a Taylor cone. The jet transitions to form a stretched jet, after the jet leaves the orifice of the nozzle, and then the jet divides into many fibers in an area called the "splaying region".

As the jet of positively charged polymer solution travels from the orifice to the collector, a "whipping motion" (or bending instability) results in the jet.

As the jet of positively charged polymer solution travels from the orifice of the jet to the collector, a magnetic field is induced, which creates the whipping motion (or bending instability) of the jet. The magnetic field is induced by the motion of the charged polymer solution, or in other words, by the motion of charged particles of the polymer solution.

The whipping motion (or bending instability) may be controlled by controlling the electric field in the vicinity of the jet and/or in the vicinity of the collector.

Properties of the resulting fibers may be also controlled, during the electrospinning process, as disclosed in various embodiments of the present invention. The present invention may be used to producing substantially long fibers for use as nano filaments and nano filament lines, and to aid in weaving fabrics of nanofibers. The present invention may be used to stretch the nanofibers during construction, production, processing, and manufacturing of the nanofibers, as a means of modifying the properties of the nanofibers, and enhancing physical parameters, chemical parameters, strength, resilience, size, diameter, orientation, molecular structure, electrical properties, and other key properties.

Figure 1:
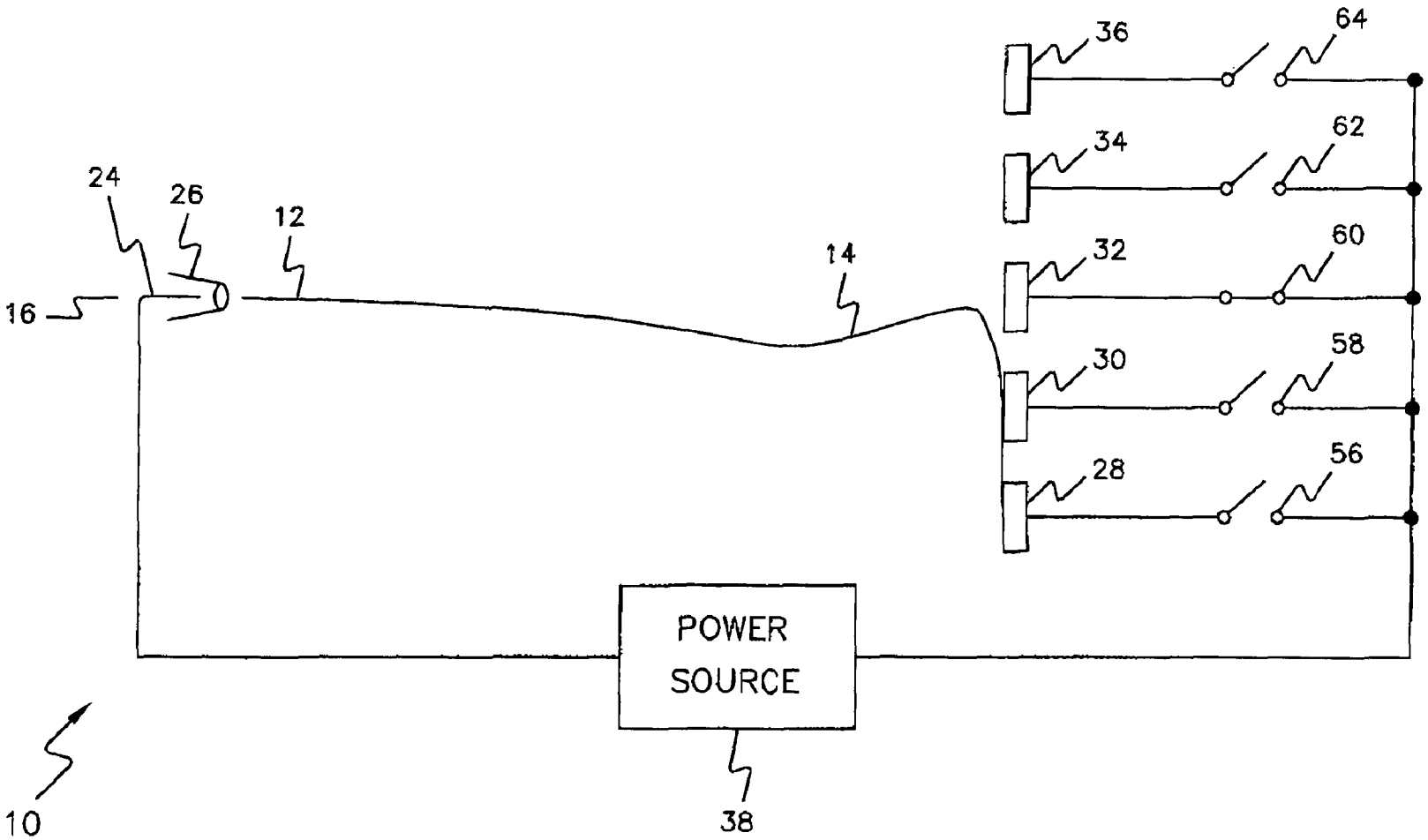
FIG. 1 is a schematic representation of an electrospinning apparatus, constructed in accordance with the present invention, having switches for controlling an electric field between at least one collector of a plurality of collectors and a jet of the electrospinning apparatus.

FIG. 1 shows an embodiment of the present invention, an electrospinning apparatus 10, which controls motion of a jet 12 of charged polymer fluid, hereinafter designated as the jet 12, during electrospinning of polymer fiber 14. The electrospinning apparatus 10 has jet supply device 16, which has electrode 24 and spinneret 26 for discharging the jet 12 from the jet supply device 16. The electrospinning apparatus 10 has collectors 28, 30, 32, 34, and 36 for collecting the polymer fiber 14 and power source 38 in electrical communication with and supplying power to the electrode 24 and to each of the collectors 28, 30, 32, 34, and 36. Switches 56, 58, 60, 62, and 64 are used to control which of the collectors 28, 30, 32, 34, and 36 is in electrical communication with the electrode 24 and the power source 38 at any particular time. The potential difference between any one or more of the collectors 28, 30, 32, 34, and 36 which are in electrical communication with the electrode 24 draws the jet 12 from the jet supply device 16 toward the particular one or more of the collectors 28, 30, 32, 34, and 36 in electrical communication with the electrode 24, the polymer fiber 14 being formed, upon approaching the particular one or more of the collectors 28, 30, 32, 34, and 36 in electrical communication with the electrode 24, and collected at the appropriate one or more of the collectors 28, 30, 32, 34, and 36.

At least one of switches 56, 58, 60, 62, and 64 is set to a closed position, as a means of controlling application of voltage to one or more of the collectors 28, 30, 32, 34, and 36, thus, controlling the electric field between the one or more of the collectors 28, 30, 32, 34, and 36 and the electrode 24, and thus, controlling the motion of the jet 12.

The switches 56, 58, 60, 62, and 64 are timewise controlled, thus, controlling which of the collectors 28, 30, 32, 34, and 36 has voltage applied thereto at any particular time, and as voltage is applied to a respective one of the collectors 28, 30, 32, 34, and 36, the polymer fiber 14 is drawn to that respective one of the collectors 28, 30, 32, 34, and 36, weaving the polymer fiber 14 from respective collector to a next respective collector, and so on. The polymer fiber 14 may, thus, be woven from the collector 28 to the collector 30 to the collector 32 to the collector 34 to the collector 36 and vice versa, once and/or repetitively.

The switch 60 is shown closed in FIG. 1, merely as an example of a closed switch, although any one or more of the switches 56, 58, 60, 62, and 64 may be closed or opened at any particular time.

Figure 2:
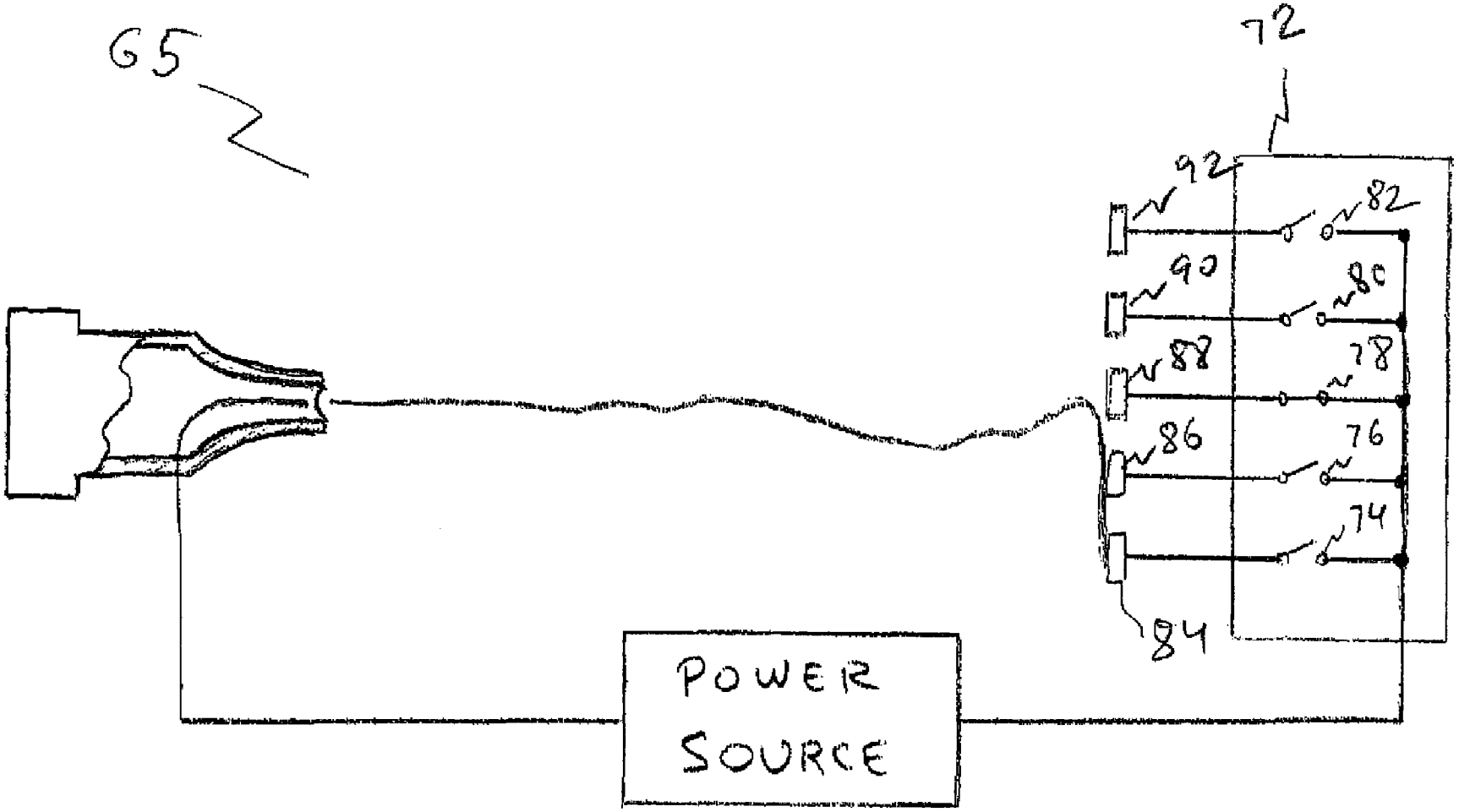
FIG. 2 is a schematic representation of an alternate embodiment of the electrospinning apparatus of FIG. 1, having a controller and switches for controlling an electric field between at least one collector of a plurality of collectors and a jet of the electrospinning apparatus.

FIG. 2 shows an alternate embodiment of an electrospinning apparatus 70, which is substantially the same as the electrospinning apparatus 10, except that the electrospinning apparatus 70 has controller 72 having switches 74, 76, 78, 80, and 82.

The controller 72 controls which of the switches 74, 76, 78, 80, and 82 have power applied thereto at any particular time, the time duration, and the sequence of which of the collectors 84, 86, 88, 90, and 92 is in electrical communication with the jet supply device 94 at any particular time.

Each of collectors 84, 86, 88, 90, and 92 is in electrical communication with jet supply device 94 at least once during a prescribed time period, as controlled by the controller 72.

The controller 72 controls which of each of the collectors 84, 86, 88, 90, and 92 is in electrical communication with the jet supply device 94 at least once during the prescribed time period and the sequence in which each of the collectors 84, 86, 88, 90, and 92 is in electrical communication with the jet supply device 94.

The controller 72 may be a controller, a computer, a processor, a commutator, a sequencer, a timer, or other suitable controller that controls which one or more of the switches 74, 76, 78, 80, and 82 are in open and/or closed positions.

The controller 72 may have a timer for controlling the duration of time that each of the switches 74, 76, 78, 80, and 82 and, thus, the time that each of the collectors 84, 86, 88, 90, and 92 is in electrical communication with the jet supply device 94.

Two or more of the collectors 84, 86, 88, 90, and 92 may alternatively be in electrical communication with the jet supply device 94 at any particular time.

The controller 72 may be used to control the sequence and time duration of which each of the collectors 84, 86, 88, 90, and 92 is in electrical communication with the jet supply device 94 at least once during the time period, so as to weave polymer fiber 96 into a fabric.

FIG. 2 shows the collectors 84, 86, 88, 90, and 92 laid out in a pattern in which each of the collectors 84, 86, 88, 90, and 92 is substantially collinear with each other. It should be understood, however, that the collectors 84, 86, 88, 90, and 92 may be laid out in an infinite variety of patterns. For example, the collectors 84, 86, 88, 90, and 92 may be laid out in a circular pattern or even a spiral pattern, each of the different patterns of the infinite variety of patterns achieving a different configuration of the fiber 96, properties of the fiber 96, and/or the weave of the fabric.

An electrospinning method of the present invention for spinning a polymer fiber from a fluid comprising a polymer in the presence of an electric field established between at least one collector of a plurality of collectors and a jet supply device, comprises:

a) forming an electrospinning jet stream of the fluid directed toward the at least one collector of the plurality of collectors;

b) controlling sequence and at least one time duration of which of each the at least one collector of the plurality of collectors forms the electric field between the at least one collector of the plurality of collectors and the jet supply device at least once during a time period;

c) drawing the jet stream toward each of the at least one collector of the plurality of collectors having the electric field between the at least one collector of the plurality of collectors and the jet supply device during the at least one time duration;

d) forming the polymer fiber at each of the at least one collector of the plurality of collectors having the electric field between the at least one collector of the plurality of collectors and the jet supply device during the at least one time duration.

The fluid comprising the polymer is from the group consisting of but not limited to: a fluid; a fluid comprising a polymer, a polymer solution, a polymer dispersion, a polymer melt, a melt, a sol, a solution, a colloid, a suspension, a dispersion, a coarse mixture, a micelle-containing compound, a foam, an aerosol, a liquid, a gas, and any combination of at least two thereof.

Figure 3:
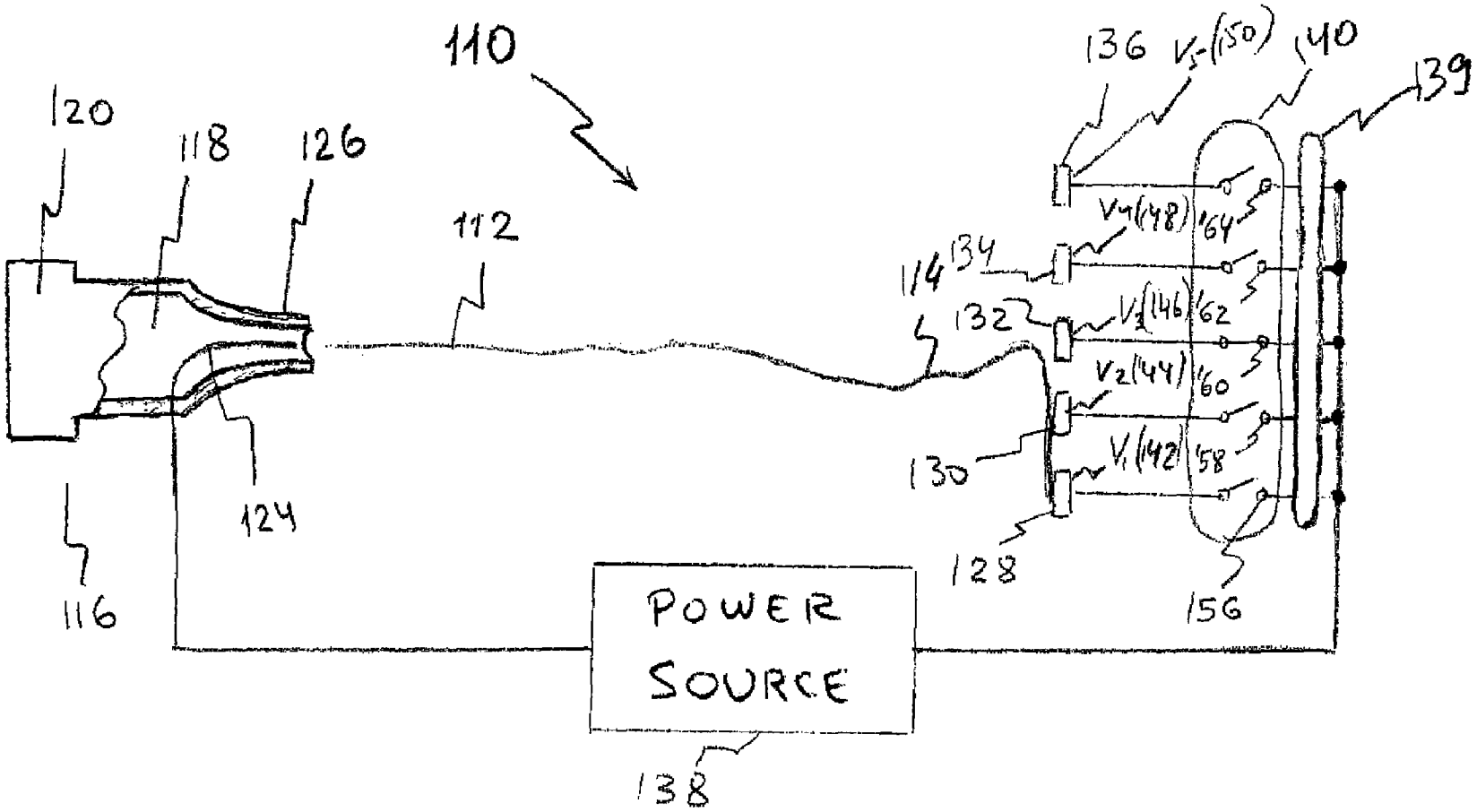
FIG. 3 is a schematic representation of an alternate embodiment of an electrospinning apparatus, constructed in accordance with the present invention, having a controller and switches for controlling an electric field between at least one collector of a plurality of collectors and a jet of the electrospinning apparatus, at least two of the collectors having different voltages applied thereto.

FIG. 3 shows an alternate embodiment of an electrospinning apparatus 100, which is substantially the same as the electrospinning apparatus 10, except that the electrospinning apparatus 100 has collectors 128, 130, 132, 134, and 136 at least two of the collectors 128, 130, 132, 134, and 136 timewise having different voltages applied thereto.

The electrospinning apparatus 100 controls motion of a jet 112 of charged polymer fluid, hereinafter designated as the jet 112, during electrospinning of polymer fiber 114, an electrode 124, and a spinneret 126, the spinneret 126 for discharging the jet 112 from the jet supply device 116. The electrospinning apparatus 100 has the collectors 128, 130, 132, 134, and 136 for collecting the polymer fiber 114, a power source 138, a voltage controller 139 and a controller 140 for switching on or off voltages $V_1$ (142), $V_2$ (144), $V_3$ (146), $V_4$ (148), and $V_5$ (150) applied to the collectors 128, 130, 132, 134, and 136 at any particular time.

The power source 138 is in electrical communication with and supplies power to the electrode 124 and the voltage controller 139. The controller 140 controls which of the collectors 128, 130, 132, 134, and 136 has voltage applied thereto. The voltage controller 139 provides power at the voltages $V_1$ (142), $V_2$ (144), $V_3$ (146), $V_4$ (148), and $V_5$ (150) to the controller 140, which determines which of the collectors 128, 130, 132, 134, and 136 has the voltages $V_1$ (142), $V_2$ (144), $V_3$ (146), $V_4$ (148), and $V_5$ (150) timewise applied thereto, by controlling which of switches 156, 158, 160, 162, and 164 of the controller 140 are opened or closed at any particular time, and, thus, which of the collectors 156, 158, 160, 162, and 164 are switched on or off at any particular time.

The potential difference between one or more of the collectors 128, 130, 132, 134, and 136 that are switched on at any particular time and the electrode 124 draws the jet 112 from the jet supply device 116 toward the one or more of the collectors 128, 130, 132, 134, and 136 that are switched on, the polymer fiber 114 being formed, upon approaching the one or more of the collectors 128, 130, 132, 134, and 136 that are switched on at any particular time, and collected at the appropriate collectors 128, 130, 132, 134, and 136.

At least one of switches 156, 158, 160, 162, and 164 is set to a closed position, as a means of controlling application of voltage to one or more to one or more of the collectors 128, 130, 132, 134, and 136, thus, controlling the electric field between the one or more of the collectors 128, 130, 132, 134, and 136 and the electrode 124, and thus, controlling the motion of the jet 112.

The switches 156, 158, 160, 162, and 164 are timewise controlled, thus, controlling which of the collectors 128, 130, 132, 134, and 136 has voltage applied thereto at any particular time, and as voltage is applied to a respective one of the collectors 128, 130, 132, 134, and 136, the polymer fiber 114 is drawn to that respective one of the collectors 128, 130, 132, 134, and 136, weaving the polymer fiber 114 from respective collector to a next respective collector, and so on. The polymer fiber 114 may, thus, be woven from the collector 128 to the collector 130 to the collector 132 to the collector 134 to the collector 136 and vice versa, once and/or repetitively.

The electrospinning apparatus 100 uses electrostatic focusing. The dispersion of the jet 112 is controlled by controlling the electric field in the vicinity of the jet 112 of the electrospinning apparatus 100. At least two of the voltages $V_1$ (142), $V_2$ (144), $V_3$ (146), $V_4$ (148), and $V_5$ (150) at the collectors 128, 130, 132, 134, and 136 are set to be different from each other, as a means of further controlling the electric fields between the electrode 124 and each of the collectors 128, 130, 132, 134, and 136, and 36, and, thus, controlling the whipping motion of the jet 112 and stabilizing bending motion of the jet 112, as the jet 112 is drawn toward the respective collector. The voltage controller 139, thus, may be used to focus the jet 112, which typically travels from the spinneret 126 in a rapidly rotating spiral motion.

The controller 140 may be used to apply one or more or of the voltages $V_1$ (142), $V_2$ (144), $V_3$ (146), $V_4$ (148), and $V_5$ (150) to any one or more of the collectors 128, 130, 132, 134, and 136 at any point in time and/or sequentially switch the voltages $V_1$ (142), $V_2$ (144), $V_3$ (146), $V_4$ (148) to any one or more of the collectors 128, 130, 132, 134, and 136 at any point in time. The controller 140 may also be used to apply different ones of the voltages $V_1$ (142), $V_2$ (144), $V_3$ (146), $V_4$ (148) to the same ones of the collectors 128, 130, 132, 134, and 136 at different points in time.

The controller 140 may be a controller, a computer, a processor, a commutator, a sequencer, a timer, or other suitable controller that controls which one or more of the switches 74, 76, 78, 80, and 82 are in open and/or closed positions. Alternatively, the controller 140 and the voltage controller 139 may be combined into a single controller that controls the voltages $V_1$ (142), $V_2$ (144), $V_3$ (146), $V_4$ (148), and $V_5$ (150) applied to the collectors 128, 130, 132, 134, and 136 and timewise which of the collectors 128, 130, 132, 134, and 136 are switched on and/or off at any point in time.

FIG. 4 shows an alternate embodiment of an electrospinning apparatus 200, which is substantially the same as the electrospinning apparatus 10, except that the electrospinning apparatus 200 has electrodes 230 and 246 for controlling whipping motion of a jet 202 of charged polymer fluid, hereinafter designated as the jet 202, during electrospinning of polymer fiber 204.

The electrospinning apparatus 200 has jet supply device 206, which has electrode 208 and spinneret 210 for discharging the jet 202 from the jet supply device 206. The electrospinning apparatus 200 has collectors 232, 234, 236, 238, and 240 for collecting the polymer fiber 204, electrodes 230 and 246, and power sources 248 and 250. The power source 248 supplies power to the electrode 208 and electrode 230, and the power source 250 supplies power to the electrode 246 and to one or more of the collectors 232, 234, 236, 238, and 240, when a respective one or more of switches 256, 258, 260, 262, and 264 are closed by controller 268.

The jet 202 is drawn to respective ones of one or more of the collectors 232, 234, 236, 238, and 240, and the polymer fiber 204 is formed as the jet 202 approaches the appropriate one or more of the collectors 232, 234, 236, 238, and 240. The electrodes 230 and 246 influence the electric field in the vicinity of the jet 202, thus, controlling the whipping motion of the jet 202.

FIG. 5 shows an alternate embodiment of an electrospinning apparatus 300, which is substantially the same as the electrospinning apparatus 100, except that the electrospinning apparatus 300 has switches 356, 358, 360, 362, and 364, which are timewise controlled by controller 344, which controls which of the collectors 328, 330, 332, 334, and 336 has voltages $V_1$ (322), $V_2$ (324), $V_3$ (326), $V_4$ (328), and $V_5$ (330) applied thereto at any particular time, as in the electrospinning apparatus 100, and the electrospinning apparatus has electrodes 308 and 312 and power sources 310 and 316, as in the electrospinning apparatus 200 for controlling the whipping motion of jet 302.

The switches 356, 358, 360, 362, and 364 are timewise controlled by the controller 344, thus, controlling which of the collectors 328, 330, 332, 334, and 336 has voltage applied thereto at any particular time, and as voltage is applied to a respective one of the collectors 328, 330, 332, 334, and 336, polymer fiber 304 is drawn to that respective one of the collectors 328, 330, 332, 334, and 336, weaving the polymer fiber 304 from respective collector to a next respective collector, and so on. The polymer fiber 304 may, thus, be woven from the collector 328 to the collector 330 to the collector 332 to the collector 334 to the collector 336 and vice versa, once and/or repetitively.

The electrospinning apparatus 300 uses electrostatic focusing. The dispersion of the jet 302 is controlled by controlling the electric field in the vicinity of the jet 302 of the electrospinning apparatus 300. At least two of the voltages $V_1$ (322), $V_2$ (324), $V_3$ (326), $V_4$ (328), and $V_5$ (330) at the collectors 328, 330, 332, 334, and 336 are set to be different from each other, as a means of further controlling the electric fields, and, thus, controlling the whipping motion of the jet 302 and stabilizing bending motion of the jet 302, as the jet 302 is drawn toward the respective collector. The controller 344 and voltage controller 318, thus, may be used to focus the jet 112, which typically travels from the jet supply device in a rapidly rotating spiral motion.

The electrodes 308 and 312 are used to further control the whipping motion of the jet 302, as in the electrospinning apparatus 200.

The controller 344 may be a controller, a computer, a processor, a commutator, a sequencer, a timer, or other suitable controller that controls which one or more of the switches 356, 358, 360, 362, and 364 are in open and/or closed positions. Alternatively, the controller 344 and the voltage controller 318 may be combined into a single controller that controls the voltages $V_1$ (322), $V_2$ (324), $V_3$ (326), $V_4$ (328), and $V_5$ (330) applied to one or more of the collectors 328, 330, 332, 334, and 336 and timewise which of the collectors 328, 330, 332, 334, and 336 are switched on and/or off at any point in time.

FIG. 6 shows an alternate embodiment of the present invention, an electrospinning apparatus 380, which controls transformation of a jet 382 of charged polymer fluid, hereinafter designated as the jet 382, during electrospinning of polymer fiber 384. The electrospinning apparatus 380 has jet supply device 386, which has electrode 388 and spinneret 390 for discharging the jet 382 from the jet supply device 386. The electrospinning apparatus 380 has power source 394 and collector frame 398, which acts as a collector. The collector frame 398 comprises a collector in the shape of a frame. The collector frame 398 may be a frame, a framework, a rectangular frame, a trapezoidal frame, a square frame, a loop, a frame having a cross or a plurality of elements or wires connected to boundaries of the frame, a coil, a multiloop coil, a three dimensional frame, any combination of thereof, or any other suitable frame or frames. As the jet 382 is drawn toward the collector frame 398, polymer fiber 384 is collected at the collector frame 398 in a random pattern.

FIGS. 7 and 8 show alternate embodiments of collector frames 400 and 405.

The collector frame 400 has a cross 401 or a plurality of elements or wires 402 and 403 connected to boundaries of frame 404.

The collector frame 405 has outer frame portions 406, 407, and 408 and interior support members 409, 410, and 411. The interior support members 409, 410, and 411 are substantially perpendicular to one another and intersect and interconnect one another at substantially the mid points of the interior support members 409, 410, and 411 and form a substantially centrally disposed junction 412. The outer frame portions 406, 407, and 408 are substantially perpendicular to one another and intersect and interconnect one another at substantially perpendicular junctions 413, 414, and 415 of the outer frame portions 406, 407, and 408. The interior support members 409, 410, and 411 are connected to the outer frame portions 406, 407, and 408 at the substantially perpendicular junctions 413, 414, and 415 of the outer frame portions 406, 407, and 408. The collector frame 405 may be rotated in spinning direction 416 or another suitable direction or directions and a polymer fiber or polymer fibers may be collected on the collector frame 405, during rotation.

The collector frame 305 may be cut at one point of the collector frame 305, such as a cut in a ring, and a voltage or difference of potential may be applied at opposing ends of the ring adjacent the cut, the difference of potential forcing a current through the collector frame 305 as the collector frame 305 rotates, which induces a magnetic field about the collector frame 305, and which may be used to further control electrospinning of the polymer fiber 384.

FIG. 9 shows an alternate embodiment of an electrospinning apparatus 420, which is substantially the same as the electrospinning apparatus 380, except that the electrospinning apparatus 420 has a collector frame 434 having sub collector frame portions 436, 438, 440, and 442, and a controller 456 for controlling which of a plurality of voltages is applied to one or more of the collector frame portions 436, 438, 440, and 442, as in the electrospinning apparatus 100.

The electrospinning apparatus 420 has jet supply device 426, which has electrode 428 and spinneret 430 for discharging the jet 422 from the jet supply device 426. The electrospinning apparatus 420 has power source 432 and collector frame 434. The collector frame 434 comprises the sub collector frame portions 436, 438, 440, and 442, each of which are conductive and insulated from one another by insulators 444, 446, 448, and 450. The power source 432 is in electrical communication with and supplies power to the electrode 428 and the controller 456. The controller 456 has voltage control means and switching means internal thereto, the voltage control means supplying a plurality of voltages, and the switch control means determining and timewise controlling to which of the sub collector frame portions 436, 438, 440, and 442 each of the plurality of voltages is applied to at any particular time.

The potential difference between one or more of the sub collector frame portions 436, 438, 440, and 442 that are switched on at any particular time and the electrode 428 draws the jet 422 from the jet supply device 426 toward the one or more of the sub collector frame portions 436, 438, 440, and 442 that are switched on, polymer fiber 424 being formed, upon approaching the one or more of the sub collector frame portions 436, 438, 440, and 442 that are switched on at any particular time, and collected at the appropriate sub collector frame portions 436, 438, 440, and 442.

The internal switches of the controller 456 are timewise controlled, thus, controlling which of the collectors 128, 130, 132, 134, and 136 has voltage applied thereto at any particular time, and as voltage is applied to a particular one of the sub collector frame portions 436, 438, 440, and 442, the polymer fiber 424 is drawn to that particular one of the sub collector frame portions 436, 438, 440, and 442, weaving the polymer fiber 424 from that sub collector frame portion collector to a next sub collector frame portion, and so on. The polymer fiber 424 may, thus, be woven between the sub collector frame portions 436, 438, 440, and 442 in any order desired, and which is controlled by the controller 456.

FIG. 10 shows an alternate embodiment of an electrospinning apparatus 480, which is substantially the same as the electrospinning apparatus 380, except that the electrospinning apparatus 480 has a rotating collector frame 494 as in the collector frame 405.

The electrospinning apparatus 480 has jet supply device 486, which has electrode 488 and spinneret 490 for discharging the jet 482 from the jet supply device 486. The electrospinning apparatus 480 has power source 492 and the rotating collector frame 494, which is rotated by drive 496. Polymer fiber 484 is collected on the collector frame 494, as the collector frame 494 is rotated.

FIG. 11 shows an alternate embodiment of an electrospinning apparatus 500, which is substantially the same as the electrospinning apparatus 420, except that the electrospinning apparatus 500 has a frame shaped collector stretcher 548 for stretching polymer fiber 514. The frame shaped collector stretcher 548 has opposing stretcher elements 550 slidably mounted on opposing guides 552 for guiding at least one of the stretcher elements 550 longitudinally away from the opposing stretcher element 550, and which form opposing portions of the frame shaped collector stretcher 548.

The collector stretcher 548 controls transformation of a jet 512 of charged polymer fluid, hereinafter designated as the jet 512, to the polymer fiber 514, during electrospinning, and stretches the polymer fiber 514, for enhanced polymer properties, at the collector stretcher 548.

The electrospinning apparatus 500 has jet supply device 516, which has electrode 524 and spinneret 526 for discharging the jet 512 from the jet supply device 516. The electrospinning apparatus 500 has power source 530 and the collector stretcher 548 for collecting the polymer fiber 514 and stretching the polymer fiber 514.

The power source 530 is in electrical communication with and supplies power to the electrode 524 and the collector stretcher 548, which collects the polymer fiber 514 on the collector stretcher 548. The collector stretcher 548 has the opposing stretcher elements 550 slidably mounted on the opposing guides 552 for guiding at least one of the stretcher elements 550 longitudinally away from the opposing stretcher element 550, as at least one of the stretcher elements 550 is directed away from the opposing stretcher element 550, thus, longitudinally stretching the polymer fiber 514 collected on the collector stretcher 548.

The collector stretcher 548, thus, acts as a stretching device for stretching the polymer fiber 514 collected on the collector stretcher 548. Members 554 may be used to pull at least one of the stretcher elements 550 away form the opposing stretcher element 550, or other suitable means may be used to direct at least one of the stretcher elements 550 away from the opposing stretcher element 550, and, thus, stretch the polymer fiber 514.

The collector and the stretcher of the collector stretcher 548 may be integral with one another, as shown in FIG. 11 or alternatively may be separate components of the collector stretcher 548.

The electrospinning apparatus 500 may be used to stretch a plurality of the polymer fibers 514 in substantially the same direction, thus, resulting in alignment of the plurality of the polymer fibers 514 in substantially the same direction.

The electrospinning apparatus 500 may be used to produce an infinite variety of products requiring alignment of a plurality of fibers in substantially the same direction, such as, for example, a polarizer or optical polarizer having aligned fibers; high strength to mass ratio materials; electrodes; electrodes for use as controllers; ultra-strong fibers and materials; extremely lightweight materials; and materials and products that may be used, for example, in applications relating to personnel protection, armor, ground vehicles, missiles, warheads, and packaging.

The electrospinning apparatus 500 may be used to produce a single layer of substantially aligned polymer fibers, a plurality of layers of substantially aligned polymer fibers, or a plurality of layers of polymer fibers having different alignments, each layer having substantially aligned fibers within that layer, but with at least two of the plurality of layers aligned in different directions.

FIG. 12 shows an alternate embodiment of an electrospinning apparatus 560, which is substantially the same as the electrospinning apparatus 380, except that the electrospinning apparatus 560 has a stretcher collector 570 for collecting polymer fiber 572 and stretching the polymer fiber 572 in a plurality of directions 574, 576, 578, 580, 582, and 584.

FIG. 13 shows an alternate embodiment of an electrospinning apparatus 600, which is substantially the same as the electrospinning apparatus 500, except that the electrospinning apparatus 600 has collector stretcher 648 having opposing collector stretcher elements 642 and 644 slidably mounted on opposing insulated guides 652 and 654, switches 656 and 658 for controlling which of the collector stretcher elements 642 and/or 644 has voltage applied thereto at any point in time, and, thus, which of the collector stretcher elements 642 and/or 644 polymer fiber 614 is drawn to, and electrodes 636 and 640 as in the electrospinning apparatus 200 for controlling whipping motion of jet 612 of charged polymer fluid, during electrospinning of the polymer fiber 614.

The electrospinning apparatus 600 has jet supply device 616, which has electrode 624 and spinneret 626 for discharging the jet 612 from the jet supply device 616. The electrospinning apparatus 600 has power source 630 and power source 632, the power source 630 supplying power to the electrode 624 and the electrode 636, and the power source 632 supplying power to the electrode 640 and the opposing collector stretcher elements 642 and 644, as determined by which of the switches 656 and/or 658 is closed. The opposing collector stretcher elements 642 and 644 act as collectors for collecting the polymer fiber 614 and stretcher elements for stretching the polymer fiber 614, and enhancing the properties of the polymer fiber 614.

FIG. 14 shows opposing collector stretcher elements 663 and 664 of an alternate embodiment of a portion of a collector stretcher 670, which are substantially the same as the collector stretcher elements 642 and 644 of the electrospinning apparatus 600, except that the collector stretcher elements 663 and 664 have conducting portions 680, 681, 682, 683, 684, 685, 686, 687, 688, and 689 and insulating portions 690, 691, 692, 693, 694, 695, 696, and 697, which insulate adjacent ones of the conducting portions 680, 681, 682, 683, 684, 685, 686, 687, 688, and 689 from one another. Different voltages may be timewise applied to one or more of the conducting portions 680, 681, 682, 683, 684, 685, 686, 687, 688, and 689 of the collector stretcher elements 663 and 664 at any point in time, thus, controlling where, how, and when polymer fiber 674 is drawn to and collected thereon, and in what pattern the polymer fiber 674 is collected, woven, and stretched.

FIG. 15 shows an alternate embodiment of the present invention, an electrospinning apparatus 700, which controls transformation of a composite jet 712 of charged polymer fluid, hereinafter designated as the composite jet 712, during electrospinning of composite polymer fibers 714. The electrospinning apparatus 700 comprises a jet supply device 716, which has electrodes 718 and 720, spinnerets 724 and 726, a power source 730, controller 732, and collector 734. The electrode 718 charges inner jet 738, which discharges from the spinneret 724. The electrode 720 charges outer jet tube 740, which discharges from the spinneret 726. The inner jet 738 and the outer jet tube 740 form the composite jet 712.

FIG. 16 shows an end view of the jet supply device 716 of FIG. 15.

FIG. 17 shows an end view of an alternate embodiment of a jet supply device 750.

FIG. 18 shows an alternate embodiment of an electrospinning apparatus 1065, which is substantially the same as the electrospinning apparatus 70, except that the electrospinning apparatus 1065 has electrodes 1093 and 1094 in electrical communication with power source 1095 through controllers 1096 and 1097 and magnetic field generating devices, comprising magnets 1098 and 1099 in electrical communication with power source 1000 through controllers 102 and 104. The electrodes 1093 and 1094 and the magnets 1098 and 1099 develop an electric field and a magnetic field, respectively, substantially transverse to jet 1068, each of which aid in controlling dispersion of the jet 1068 of the electrospinning apparatus 1065.

FIG. 18 also shows jet supply device 1067 for discharging the jet 1068, reservoir 1070 having a fluid, electrode 1071, pump 1072 for pumping the fluid from the reservoir 1070, and spinneret 1073 for discharging the jet 1068 from the jet supply device 67, and collectors 84, 86, 88, 90, and 92, for more detail.

FIG. 19 shows a side view of an alternative embodiment of a collector 1370, having an inner collector portion 1372, which may be a conductor; a semiconductor; a conductor covered by a semiconductor, and/or combination thereof, and outer portion 1374, which may be an insulator, such as a dielectric; a semiconductor insulated by a dielectric; and/or combination thereof.

FIG. 20 shows a loom 1400 for weaving electrospun fibers 1402 and 1404 into a fabric. The loom comprises delivery collectors 1406 and 1408 delivering fiber 1404 and delivery collectors 1410 and 1412 delivering fiber 1402. The loom further comprises upper collectors 1484, 1486, 1488, 1490, and 1492 insulated by insulators 1494, 1496, 1498, and 1499, lower collectors 1502 and 1504, and lower collectors 1506, 1508, and 1510. Initial positions of lower and upper collectors are similar to collector positions shown on FIG.14. For instance, left collectors 680, 683, 684, 687, and 688 of FIG. 14 are similar to lower collectors 1510, 1504, 1508, 1502, and 1506 of FIG. 20 respectively. Right collectors 681, 682, 685, 686, and 689 of FIG. 14 are similar to upper collectors 1492, 1490, 1488, 1486, and 1484 of FIG. 20 respectively. The initial position of collectors 1484, 1486, 1488, 1490, 1492, 1502, 1504, 1506, 1508, and 1510 is a position preceding delivery of fibers 1404 and 1402 by collectors 1406, 1408, 1410 and 1412 to the upper area. At the initial position a potential difference is applied between collector 1510 and an electrode of a jet supply device (said electrode of said jet supply device is not shown on FIG. 20). Said jet supply device delivers a jet to collector 1510, which said jet becomes a fiber. Van der Waals or other forces secure said fiber to collector 1510 assuring sufficient adhesion of said fiber to collector 1510. Said potential difference between collector 1510 and said electrode of said jet supply device is disconnected after said fiber has been secured to collector 1510. The same or another potential difference is applied between collector 1492 and said electrode of said jet supply device and said jet supply device delivers said jet to collector 1492, which said jet becomes a fiber. Van der Waals or other forces secure said fiber to collector 1492 assuring sufficient adhesion of said fiber to collector 1492. Said potential difference between collector 1492 and said electrode of said jet supply device is disconnected after said fiber has been secured to collector 1492. The same or another potential difference is applied between collector 1490 and said electrode of said jet supply device and said jet supply device delivers said jet to collector 1490, which said jet becomes a fiber. Van der Waals or other forces secure said fiber to collector 1490 assuring sufficient adhesion of said fiber to collector 1490. Said potential difference between collector 1490 and said electrode of said jet supply device is disconnected after said fiber has been secured to collector 1490. The same or another potential difference is applied between collector 1504 and said electrode of said jet supply device and said jet supply device delivers said jet to collector 1504, which said jet becomes a fiber, weaving said fiber from collector 1510 to collector 1492, and then to collector 1490, and then to collector 1504, and so on if necessary. The similar fiber movement is performed from collector 1508 to collector 1498, and then to collector 1496, and then to collector 1502, and so on if necessary. The similar fiber movement is performed from collector 1506 to collector 1484, and so on if necessary. The similar movement of fiber 1404 is performed from collector 1406 to collector 1408, and so on if necessary. The similar movement of fiber 1402 is performed from collector 1410 to collector 1412, and so on if necessary. Lower collectors 1502 and 1504 and lower collectors 1506, 1508, and 1510 each oscillate transverse to the axis of upper collectors 1484, 1486, 1488, 1490, and 1492 and insulators 1494, 1496, 1498, and 1499. For instance, collectors 1502 and 1504 move right from said initial position and collectors 1506, 1508, and 1510 move left from said initial position. The resulting collector position becomes open for fiber 1404, which is moved upward by collectors 1406 and 1408 toward the plurality of upper collectors 1484, 1486, 1488, 1490, and 1492 and the insulators 1494, 1496, 1498, and 1499 as shown by upward arrow on the left side of FIG. 20. Collectors 1406 and 1408 stretch fiber 1404 as shown by three arrows at the bottom of FIG. 20. After fiber 1404 is stabilized at the upper position collectors 1502 and 1504 move left and collectors 1506, 1508, and 1510 move right. This position becomes locked for fiber 1404 delivered by collectors 1406 and 1408 and becomes open for fiber 1402 moved upward by collectors 1410 and 1412 toward the plurality of upper collectors 1484, 1486, 1488, 1490, and 1492 and the insulators 1494, 1496, 1498, and 1499 thus weaving the fibers 1402 and 1404. This exact position is shown on FIG. 20. Collectors 1410 and 1412 move fiber 1402 upward as shown by upward arrow on the left side of FIG. 20. Collectors 1410 and 1412 stretch fiber 1402 as shown by three arrows at the bottom of FIG. 20. As a next step, collectors 1502 and 1504 move right and collectors 1506, 1508, and 1510 move left locking fiber 1402 and becoming ready for a next fiber to be moved upward (said next fiber is not shown on FIG. 20). The described device weaves electrospun fibers into a fabric.

A combination of the proposed methods may have a specific application such as, for example, a fiber/nanofiber plait. Multiple collectors insulated from each other are positioned in a circle. At least one collector is in the center of the circle. Collectors are in electrical communication with controlling devices. Initial on position goes to the central collector. Initial fibers form a line from jet supply device to the central collector. On position moves to one of the circle collector and after that goes clockwise, counterclockwise or randomly. Then all later coming fibers make circles around the line forming a plait or later coming fibers are spinning around the axis parallel to the main electric field creating the plait of fibers/nanofibers. Potential difference between controlling devices and/or collectors is changing creating the plait of fibers/nanofibers.

One fiber/nanofiber collector is a frame or any combination of frames of any shape. For example, the collector is a framework, or a loop, or a cross loop, or a cross circular loop, a cross-rectangular loop, or a coil, or a rectangular loop, or a rectangular coil, or a square loop, or a circular coil, or a square coil, or multiloop coil, or any combination of above.

The electrospun fibers/nanofibers being formed inside the said type of the collector are like a spider's web, or a portion of a spider's web, or a cobweb, or gossamer. Initial fibers form a scaffold for later coming fibers.

At least one fiber/nanofiber collector is a stretching device, which comprises grips (clamp, adhesion or any other nature) for holding a fiber/nanofiber 614 or fibers/nanofibers wherein the said fiber/nanofiber or said fibers/nanofibers are stretched by the said stretching device. The said frame is capable of stretching fiber/nanofibers up to 1000%. The said stretching device is stretching fibers/nanofibers, which said fibers/nanofibers consist of piezo-electric material.

A yarn of electrospun nanofibers produced by the process comprising the steps of: at least one fiber/nanofiber collector is a stretching device, which comprises grips (clamp, adhesion or any other nature) for holding a fiber/nanofiber or fibers/nanofibers wherein the said fiber/nanofiber or said fibers/nanofibers are stretched by the said stretching device. If the target is allowed to move with respect to the nozzle position, specific fiber orientations (parallel alignment or a random) can be achieved. Varying the fiber diameter and orientation can vary the mechanical properties of the mat.

An infinite variety of materials and products may be produced, using the apparatus and methods of the present invention, including but not limited to: nanofibers, nanofilaments; monofilament fibers; polarizers; optical polarizers; woven fibers; mats; advanced adsorbent bed materials; layered adsorbents and their compositions to enhance chemical agent and toxic industrial chemical removal; high strength to mass ratio materials; electrodes; electrodes for use as controllers; ultra-strong fibers and materials; extremely lightweight materials; and materials and products that may be used, for example, in applications relating to personnel protection, armor, ground vehicles, missiles, warheads, and packaging.

The apparatus and methods of the present invention may be enhanced by elevated or depressed pressures and or temperatures; electromagnetic radiation; gamma-ray radiation, x-ray radiation; a laser, ultraviolet, visible, infrared and/or microwave radiation, use of an electron gun; a source or sources of protons, neutrons, and/or other particles to force moving molecules into an ionized state.

Although the present invention has been described in considerable detail with reference to certain preferred versions thereof, other versions are possible. Therefore, the spirit and scope of the appended claims should not be limited to the description of the preferred versions contained herein.

What is claimed is:

1. An electrospinning apparatus for spinning a polymer fiber from a fluid that comprises a polymer, comprising:

a plurality of collectors;

said collectors are insulated from each other;

a potential difference is applied between one of said collectors and an electrode of a jet supply device;

said jet supply device delivering a quantity of fluid;

said potential difference is applied to a respective one of said collectors, said polymer fiber is drawn to said respective one of said collectors, said potential difference is disconnected from said respective one of said collectors and applied to a next respective collector of said collectors weaving said polymer fiber from said respective one of said collectors to said next respective collector of said collectors, and so on;

said polymer fiber is woven from said respective one of said collectors to said next respective collector of said collectors to any other collector or collectors of said collectors and vice versa, once or repetitively;

a controller controlling sequence and of which said potential difference is applied to said respective one of said collectors, said next respective collector of said collectors, any other collector or collectors of said collectors being in electrical communication with said jet supply device at least once during a time period.

2. The apparatus of claim 1, wherein at least two of said collectors timewise having different potential differences applied thereto.

3. The apparatus of claim 1, wherein:

said electrospinning apparatus has a power source, which simultaniously supplies at least two different potential differences;

said controller controls said sequence of said at least two different potential differences between said at least one collector of said plurality of collectors and said jet supply device.

4. The apparatus of claim 1, wherein:

said electrospinning apparatus has a power source, which supplies at least two differences of potential;

said controller controls which of said at least two differences of potential are supplied between at least two different ones of said at least one collector of said plurality of collectors and said jet supply device at any particular time and influences said electric field.

5. The apparatus of claim 4, wherein said controller controls said sequence and said at least one time duration of which of each said at least two differences of potential are supplied between said at least two different ones of said at least one collector of said plurality of collectors and said jet supply device.

6. The apparatus of claim 1, wherein:

said electrospinning apparatus has a power source, which supplies at least two differences of potential;

said controller controls which of said at least two differences of potential are supplied between each of said collectors and said jet supply device at any particular time and influences said electric field.

7. The apparatus of claim 1, wherein said electrospinning apparatus has at least one additional-control electrode adapted to influence said electric field in the vicinity of said quantity of said fluid as said quantity of fluid is drawn from said jet supply device toward at least one collector and reduce whipping motion of said quantity of fluid.

8. The apparatus of claim 1, wherein said controller controls said sequence and said at least one time duration of which of each at least one collector of said plurality of collectors is in electrical communication with said jet supply device at least once during said time period so as to create a nonwoven fabric.

9. The apparatus of claim 1, wherein said controller controls said sequence and said at least one time duration of which of each at least one collector of said plurality of collectors is in electrical communication with said jet supply device at least once during said time period so as to weave said polymer fiber into a fabric.

10. The apparatus of claim 1, wherein said polymer fiber comprises composite fibers.

11. An electrospinning apparatus for spinning a polymer fiber from a fluid that comprises a polymer, comprising:

a plurality of collectors;

said collectors are insulated from each other;

a jet supply device delivering a quantity of fluid;

at least one collector of said plurality of collectors in electrical communication with said jet supply device during at least one time duration;

said at least one collector and said jet supply device adapted to form an electric field therebetween and draw said quantity of fluid from said jet supply device toward said at least one collector and form said polymer fiber at said at least one collector of said plurality of collectors in electrical communication with said jet supply device during said at least one time duration;

a controller controlling sequence and said at least one time duration of which of each said at least one collector of said plurality of collectors is in electrical communication with said jet supply device at least once during a time period;

said at least one collector of said plurality of collectors in electrical communication with said jet supply device further comprises a stretcher adapted to stretch said polymer fiber;

said stretcher comprises at least two collectors stretching said polymer fiber by said collectors adapted to move away from each other applying tensile deformation to said polymer fiber.

12. The apparatus of claim 11, wherein said stretcher is an integral part of said at least one collector.

13. The apparatus of claim 11, wherein said stretcher adapted to stretch a plurality of polymer fibers.

14. The apparatus of claim 13, wherein said polymer fibers are composite fibers.

15. An electrospinning apparatus for spinning a polymer fiber from a fluid that comprises a polymer, comprising:

a plurality of collectors;

said collectors are insulated from each other;

a jet supply device delivering a quantity of fluid;

at least one collector of said plurality of collectors in electrical communication with said jet supply device during at least one time duration;

said at least one collector and said jet supply device adapted to form an electric field therebetween and draw said quantity of fluid from said jet supply device toward said at least one collector and form said polymer fiber at said at least one collector of said plurality of collectors in electrical communication with said jet supply device during said at least one time duration;

a controller controlling sequence and said at least one time duration of which of each said at least one collector of said plurality of collectors is in electrical communication with said jet supply device at least once during a time period;

said at least one collector of said plurality of collectors in electrical communication with said jet supply device comprises at least two collectors adjacent one another sequentially in electrical communication with said jet supply device;

said at least two collectors are adapted to move away from each other controlling tensile deformation of at least one polymer fiber attached to each of said at least two collectors.

16. The apparatus of claim 15, wherein:

said at least two adjacent collectors further comprise at least one stretcher adapted to stretch said polymer fiber;

said polymer fiber is attached to each of at least two adjacent collectors;

said stretcher comprises said at least two adjacent collectors stretching said polymer fiber by said collectors adapted to move away from each other.

17. The apparatus of claim 16, wherein said at least one stretcher is integral part with said at least two collectors.

18. The apparatus of claim 15, wherein said electrospinning apparatus has at least one additional-control electrode adapted to influence said electric field in the vicinity of said quantity of said fluid as said quantity of fluid is drawn from said jet supply device toward said at least one collector and reduce whipping motion of said quantity of fluid.

19. The apparatus of claim 15, wherein said controller controls said sequence and said at least one time duration of which of each said at least one collector of said plurality of collectors is in electrical communication with said jet supply device at least once during said time period so as to create a nonwoven fabric.

20. The apparatus of claim 15, wherein said controller controls said sequence and said at least one time duration of which of each said at least one collector of said plurality of collectors is in electrical communication with said jet supply device at least once during said time period so as to weave said polymer fiber into a fabric.

21. An electrospinning apparatus for spinning a polymer fiber from a fluid that comprises a polymer, comprising:

at least one collector comprising a frame;

said frame is adopted to be separated into a plurality of sub collector frame portions;

said plurality of sub collector frame portions are adopted to be assembled into said frame;

a jet supply device delivering a quantity of fluid;

said at least one collector in electrical communication with said jet supply device, said at least one collector and said jet supply device adapted to form an electric field therebetween and draw said quantity of fluid from said jet supply device toward said at least one collector and form said polymer fiber at said frame of said at least one collector;

said frame of said at least one collector comprises opposing frame portions, comprising a first opposing frame portion and a second opposing frame portion, said first opposing frame portion adapted to be directed away from said second opposing frame portion and stretch said polymer fiber.

22. The apparatus of claim 21, wherein:

said apparatus comprises a controller for controlling which of said opposing frame portions is in electrical communication with said jet supply device at any time and drawing said quantity of fluid thereto and forming said polymer fiber thereat;

said opposing frame portions are insulated from each other.

23. The apparatus of claim 21, wherein said frame adapted to stretch a plurality of polymer fibers.

24. The apparatus of claim 23, wherein said polymer fibers are composite fibers.

25. An electrospinning apparatus for spinning a polymer fiber from a fluid that comprises a polymer, comprising:

at least one collector comprising a frame;

said frame is adopted to be separated into a plurality of sub collector frame portions;

said plurality of sub collector frame portions are adopted to be assembled into said frame;

a jet supply device delivering a quantity of fluid;

said at least one collector in electrical communication with said jet supply device, said at least one collector and said jet supply device adapted to form an electric field therebetween and draw said quantity of fluid from said jet supply device toward said at least one collector and form said polymer fiber at said frame of said at least one collector;

said frame of said at least one collector comprises said plurality of sub collector frame portions adapted to be directed away from one another and stretch said polymer fiber.

26. The apparatus of claim 25, wherein said apparatus comprises a controller for controlling which of said plurality of sub collector frame portions is in electrical communication with said jet supply device at any time and drawing said quantity of fluid thereto and forming said polymer fiber there at.

27. The apparatus of claim 26, wherein said controller controls time duration and sequence of which of each one of said plurality of sub collector frame portions is in electrical communication with said jet supply device at least once during a time period.

28. The apparatus of claim 25, wherein said electrospinning apparatus further comprises a rotator adapted to rotate said frame.

29. The apparatus of claim 25, wherein said sub collector frame portions are substantially perpendicular to one another and adjoined to one another.

30. The apparatus of claim 29, wherein each of said sub collector frame portions supports at least two other said sub collector frame portions.

31. The apparatus of claim 30, wherein said electrospinning apparatus further comprises a rotator adapted to rotate said frame.

32. The apparatus of claim 25, wherein said sub collector frame portions adapted to stretch a plurality of polymer fibers.

33. The apparatus of claim 32, wherein said polymer fibers are composite fibers.

34. An electrospinning apparatus for spinning a polymer fiber from a fluid that comprises a polymer, comprising:

at least one collector comprising a collector having a stretcher;

said stretcher is adopted to separate into plurality sub collectors;

a jet supply device delivering a quantity of fluid;

said at least one collector in electrical communication with said jet supply device, said at least one collector and said jet supply device adapted to form an electric field therebetween and draw said quantity of fluid from said jet supply device toward said at least one collector and form said polymer fiber at said at least one collector;

said stretcher adapted to stretch said polymer fiber;

said stretcher comprises a frame;

said frame comprises a plurality of sub collector frame portions adapted to be directed away from one another.

35. The apparatus of claim 34, wherein said plurality of sub collector frame portions adapted to stretch said polymer fiber.

36. The apparatus of claim 34, wherein:

said plurality of sub collector frame portions comprises opposing frame portions of said sub collector frame portions, comprising a first opposing frame portion of said sub collector frame portions and a second opposing frame portion of said sub collector frame portions, said first opposing frame portion of said sub collector frame portions adapted to be directed away from said second opposing frame portion of said sub collector frame portions and stretch said polymer fiber.

37. The apparatus of claim 34, wherein said controller controls said sequence and said at least one time duration of which of each said at least one collector of said plurality of collectors is in electrical communication with said jet supply device at least once during said time period so as to create a nonwoven fabric.

38. The apparatus of claim 34, wherein said controller controls said sequence and said at least one time duration of which of each said at least one collector of said plurality of collectors is in electrical communication with said jet supply device at least once during said time period so as to weave said polymer fiber into a fabric.

39. The apparatus of claim 34, wherein said sub collector frame portions adapted to stretch a plurality of polymer fibers.

40. The apparatus of claim 39, wherein said polymer fibers are composite fibers.

41. An electrospinning apparatus for spinning a polymer fiber from a fluid that comprises a polymer, comprising:

at least one collector comprising a collector having a stretcher;

said stretcher is adopted to separate into plurality sub collectors;

a jet supply device delivering a quantity of fluid;

said at least one collector in electrical communication with said jet supply device, said at least one collector and said jet supply device adapted to form an electric field therebetween and draw said quantity of fluid from said jet supply device toward said at least one collector and form said polymer fiber at said at least one collector;

said stretcher adapted to stretch said polymer fiber;

said stretcher comprises opposing stretcher elements;

said stretcher comprises means for forcing said opposing stretcher elements away from each other.

42. The apparatus of claim 41, wherein:

said stretcher comprises opposing guides;

said opposing stretcher elements slidably mounted on said opposing guides.

43. The apparatus of claim 41, wherein said stretcher is a tensile stretcher.

44. The apparatus of claim 41, wherein said controller controls said sequence and said at least one time duration of which of each said at least one collector of said plurality of collectors is in electrical communication with said jet supply device at least once during said time period so as to create a nonwoven fabric.

45. The apparatus of claim 41, wherein said controller controls said sequence and said at least one time duration of which of each said at least one collector of said plurality of collectors is in electrical communication with said jet supply device at least once during said time period so as to weave said polymer fiber into a fabric.

46. The apparatus of claim 41, wherein said stretcher adapted to stretch a plurality of polymer fibers.

47. The apparatus of claim 46, wherein said polymer fibers are composite fibers.

* * * * *